US010291986B1

(12) United States Patent
Plitkins et al.

(10) Patent No.: US 10,291,986 B1
(45) Date of Patent: May 14, 2019

(54) INTELLIGENT AUDIO FOR PHYSICAL SPACES

(71) Applicant: Spatial Inc., Emeryville, CA (US)

(72) Inventors: Michael M. Plitkins, Emeryville, CA (US); Terrin Dale Eager, Emeryville, CA (US); Joseph A Ruff, Emeryville, CA (US); Steve Hales, Emeryville, CA (US); Mark S. Deggeller, Emeryville, CA (US); Mihnea Calin Pacurariu, Emeryville, CA (US)

(73) Assignee: SPATIAL, INC., Emeryville, CA (US)

( * ) Notice: Subject to any disclaimer, the term of this patent is extended or adjusted under 35 U.S.C. 154(b) by 0 days.

(21) Appl. No.: 15/918,917

(22) Filed: Mar. 12, 2018

(51) Int. Cl.
*H04R 3/12* (2006.01)
*H04R 5/02* (2006.01)
*H04R 5/04* (2006.01)

(52) U.S. Cl.
CPC ..... *H04R 3/12* (2013.01); *H04R 5/02* (2013.01); *H04R 5/04* (2013.01)

(58) Field of Classification Search
CPC ..... H04R 3/12; H04R 5/02; H04R 5/04
See application file for complete search history.

(56) References Cited

U.S. PATENT DOCUMENTS 9,484,030 B1 11/2016 Meaney et al.

*Primary Examiner* — Mark Fischer
(74) *Attorney, Agent, or Firm* — Maschoff Brennan

(57) ABSTRACT

An audio system may include a communication interface configured to obtain first audio data and second audio data from an audio data source. The audio system may also include memory configured to store the first audio data and the second audio data. The audio system may also include a sensor configured to detect a condition of an environment and to produce a sensor output signal that represents the detected condition of the environment. The audio system may also include one or more processors that may be configured to cause performance of operations. The operations may include generating an audio signal including the first audio data and adjusting the audio signal to include the second audio data based on the sensor output signal. The audio system may also include a speaker that may be configured to provide an audio experience based on the audio signal.

20 Claims, 10 Drawing Sheets

INTELLIGENT AUDIO FOR PHYSICAL SPACES

FIELD

The embodiments discussed herein are related to generation of intelligent audio for physical spaces.

BACKGROUND

Many environments are augmented with audio systems. For example, hospitality locations including restaurants, sports bars, and hotels often include audio systems. Additionally locations including small to large venues, retail, temporary event locations may also include audio systems. The audio systems may play audio in the environment to create or add to an ambiance.

The subject matter claimed in the present disclosure is not limited to embodiments that solve any disadvantages or that operate only in environments such as those described above. Rather, this background is only provided to illustrate one example technology area where some embodiments described in the present disclosure may be practiced.

SUMMARY

According to an aspect of an embodiment, an audio system, may include a communication interface configured to obtain first audio data and second audio data from an audio data source. The audio system may also include memory communicatively coupled to the communication interface, the memory may be configured to store the first audio data and the second audio data. The audio system may also include a sensor configured to detect a condition of an environment and to produce a sensor output signal that represents the detected condition of the environment. The audio system may also include one or more processors communicatively coupled to the memory and the sensor, the one or more processors may be configured to cause performance of operations. The operations may include generating an audio signal including the first audio data; and adjusting the audio signal to include the second audio data based on the sensor output signal. The audio system may also include a speaker communicatively coupled to the one or more processors, the speaker may be configured to provide an audio experience based on the audio signal.

The object and/or advantages of the embodiments will be realized or achieved at least by the elements, features, and combinations particularly pointed out in the claims.

It is to be understood that both the foregoing general description and the following detailed description are given as examples and explanatory and are not restrictive of the present disclosure, as claimed.

BRIEF DESCRIPTION OF THE DRAWINGS

Example embodiments will be described and explained with additional specificity and detail through the use of the accompanying drawings in which.

DESCRIPTION OF EMBODIMENTS

Figure 1:
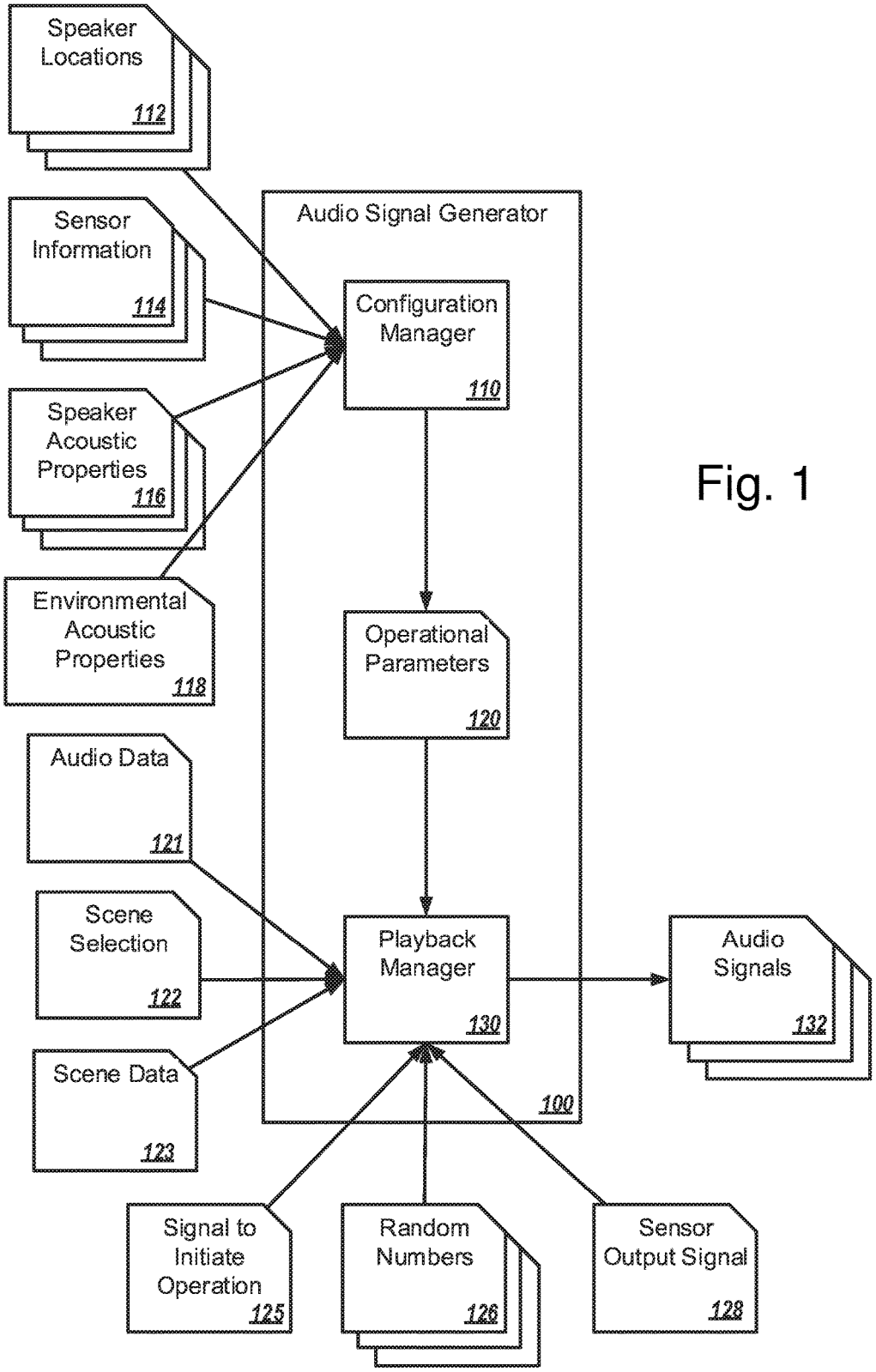
FIG. 1 is a block diagram of an example audio signal generator configured to generate audio signals for an audio system in an environment.

Conventional audio systems may have shortcomings. For example, some conventional audio systems may play the same audio at all of the speakers of the audio system. Further, while some "3D" audio systems may generate different audio signals for different speakers of the audio system, these conventional "3D" audio systems may rely on specific positioning of speakers around a listener. In another example, audio systems generally may not respond to conditions of the environment. In another example, some conventional audio systems that attempt to simulate an environment may play the same audio repeatedly such that the simulated environment may have a distinct artificial feel to it, which may annoy listeners. For example, a conventional audio system that may be configured to simulate a jungle environment for a jungle-themed restaurant may repeat a same sound track every 5 minutes. The sound track may include a bird call that repeats itself as part of the audio track every 5 minutes. A person in the environment may recognize the repetition of the bird call and be annoyed. Moreover, conventional audio systems may not be able to detect or sense environmental conditions and dynamically update the audio based on the detected environmental conditions.

Aspects of the present disclosure address these and other problems with conventional approaches by using multiple speakers to generate an audio experience. Speakers may output sound waves that are synchronized together in time, amplitude and frequencies to produce an overall volume of sound where virtual sound objects can be located and moved within a space (e.g., a virtual space). The speakers may generate different audio signals for different speakers in the environment in a dynamic manner. In addition, the different audio signals may be generated to provide a "3D" audio experience, without relying on a specific predetermined positioning of speakers that may project the audio based on the audio signals. Further, aspects of the present disclosure may include an adjustment of the audio signals based on a condition of the environment and/or based on a random number. The adjusting of the audio signals in such a manner may provide an audio experience that may change over time in a non-repetitive manner, or with the condition of the environment; which may provide for a more interactive audio experience as compared to those provided by other techniques of generating audio.

Generating audio in an environment using an audio system and/or a speaker is rooted in technology. These or other aspects of the present disclosure may include improvements to the technology of audio systems or technology for generating audio for an environment.

Systems and methods related to generating dynamic audio in an environment are disclosed in the present disclosure. Generating audio in the environment may be accomplished by providing audio at a speaker in the environment based on an audio signal. Generating the audio signal may be accomplished, for example, by composing audio data into the audio signal. The audio data may include recorded or synthesized sounds. For example the audio data may include sounds of music, birds chirping, or waves crashing. A particular audio signal may include different audio data to be played simultaneously or nearly simultaneously. For example, a particular audio signal may include the sounds of music, birds chirping, and waves crashing, all to be played around the same time or at overlapping times.

In the present disclosure, providing audio at a speaker may be referred to as playing audio, audio playback, or generating audio. Also, providing audio at a speaker based on an audio signal may be referred to as playing the audio signal. Also, reference to playing the audio data of an audio signal, or playing the sound of the audio data may refer to providing audio at a speaker in which the audio is based on the audio data.

Dynamic audio may include audio provided by one or more speakers that changes over time or in response to a condition of the environment. The dynamic audio may be generated by changing the composition of audio data in the audio signal which may be received by the speaker. For an example of dynamic audio, an audio signal may be generated for a speaker in the environment. The audio signal may initially include audio data of music. The composition of the audio signal may be changed to also include audio data of a bird chirping. Thus, when the speaker provides the audio from the audio signal of music, and when the audio signal changes to include the sound of the bird, the speaker may also provide the sound of the bird chirping in addition to the music such that the audio provided by the speaker may be dynamic.

In some embodiments the dynamic audio may be generated based on one or more random numbers. For example, audio data may be excluded, included and/or adjusted in an audio signal based on the random numbers. For example, the audio data may be selected for inclusion in the audio signal at random, or selected from a group at random. Additionally or alternatively, the audio data may be played at random times, or repeated at random or pseudo-random intervals. For example, particular audio data of a bird chirping may be randomly selected from a group of audio data of various birds chirping for inclusion in the audio signal. Further, the particular sounds of the bird chirping may be included in the audio signals at a random time. Further, the audio data of the bird chirping may have its frequency characteristics altered based on the random numbers when it is included in the audio signal. The generation of audio based on random numbers may contribute to the audio generated being dynamic.

In these or other embodiments the audio may be generated based on a condition of the environment. In some embodiments, the audio system may include a sensor in the environment. The sensor may be collocated with a speaker or may be located separate from any speaker. The sensor may detect the condition of the environment. The audio data may be excluded, included and/or adjusted in the audio signal based on the condition of the environment as detected by the sensor. For example, a song may be played based on a sensor indicating that a person has entered the environment.

In some embodiments, the audio system may include multiple speakers distributed throughout the environment. Each of the speakers may receive a different audio signal which may result in each of the speakers providing different audio. For example, in an audio system including several speakers, one speaker of the several speakers may play sounds of a bird chirping. The one speaker playing the sounds of a bird chirping may give a person in the environment the impression that a bird is chirping near the one speaker. The speakers may make sound waves that are synchronized together in time, amplitude and frequencies to produce an overall volume of sound where virtual sound objects can be located and moved within a space. For example, sound waves may be generated such that related sound waves arrive at a predetermined location at substantially the same time, or at the same time. For example, audio signals may be generated such that when they are output by two speakers at two different locations, the sound generated by the speakers arrives at one or more points in the environment at or near the same time.

In these or other embodiments, the audio system may include multiple sensors distributed throughout the environment. A particular sensor may be configured to detect a condition near the particular sensor. An audio signal for a particular speaker may be generated based on the condition detected by the particular sensor. For example, when a person enters an environment, a particular speaker of an audio system may be playing sounds of a bird chirping. If the person approaches a particular sensor that is near the particular speaker, the particular speaker may play sounds of the bird flying away from the particular speaker. Subsequently, another speaker may begin to play the sounds of the bird chirping.

According to an aspect of an embodiment, an audio system may include a communication interface configured to obtain first audio data and second audio data from an audio data source. The audio system may also include memory communicatively coupled to the communication interface, the memory may be configured to store the first audio data and the second audio data. The audio system may also include a sensor configured to detect a condition of an environment and to produce a sensor output signal that represents the detected condition of the environment. The audio system may also include one or more processors communicatively coupled to the memory and the sensor. The one or more processors may be configured to cause performance of operations including generating an audio signal including the first audio data, and adjusting the audio signal to include the second audio data based on the sensor output signal. The audio system may also include a speaker communicatively coupled to the one or more processors; the speaker may be configured to provide audio based on the audio signal.

FIG. 1 is a block diagram of an example audio signal generator 100 configured to generate audio signals 132 for an audio system in an environment arranged in accordance with at least one embodiment described in this disclosure. In general, the audio signal generator 100 generates audio signals 132 for speakers in an environment based on one or more of speaker locations 112, sensor information 114, speaker acoustic properties 116, environmental acoustic properties 118, audio data 121, a scene selection 122, scene data 123, a signal to initiate operation 125, random numbers 126, and sensor output signal 128.

The audio signal generator 100 may include code and routines configured to enable a computing system to perform one or more operations to generate audio signals 132. The audio signals 132 may be analog or digital. In at least some embodiments, the audio signal generator 100 may include a balanced and/or an unbalanced analog connection to an external amplifier, such as in embodiments where one or more speakers do not include an embedded or integrated processor. Additionally or alternatively, the audio signal generator 100 may be implemented using hardware including a processor, a microprocessor (e.g., to perform or control performance of one or more operations), a field-programmable gate array (FPGA), a digital signal processor (DSP), or an application-specific integrated circuit (ASIC). In some other instances, the audio signal generator 100 may be implemented using a combination of hardware and software. In the present disclosure, operations described as being performed by the audio signal generator 100 may include operations that the audio signal generator 100 may direct a system to perform. The audio signal generator 100 may include more than one processor that can be distributed among multiple speakers or centrally located, such as in a rack mount system that may connect to a multi-channel amplifier.

In some embodiments the audio signal generator 100 may include a configuration manager 110 which may include code and routines configured to enable a computing system to perform one or more operations to configure speakers of an audio system for operation in an environment. Additionally or alternatively, the configuration manager 110 may be implemented using hardware including a processor, a microprocessor (e.g., to perform or control performance of one or more operations), an FPGA, or an ASIC. In some other instances, the configuration manager 110 may be implemented using a combination of hardware and software. In the present disclosure, operations described as being performed by the configuration manager 110 may include operations that the configuration manager 110 may direct a system to perform.

In general the configuration manager 110 may be configured to generate operational parameters 120 that may include information that may cause an adjustment in the way audio is generated and/or adjusted. In these or other embodiments, the configuration manager 110 may be configured to generate the operational parameters 120 based on the speaker locations 112, the sensor information 114, the speaker acoustic properties 116, the environmental acoustic properties 118, room geometry, etc. For example, the configuration manager 110 may sample a room to determine a location of walls, ceiling(s), and floor(s). The configuration manager 110 may also determine locations of speakers that have been placed in the room.

The speaker locations 112 may include location information of one or more speakers in an audio system. The speaker locations 112 may include relative location data, such as, for example, location information that relates the position of speakers to other speakers, walls, or other features in the environment. Additionally or alternatively the speaker locations 112 may include location information relating the location of the speakers to another point of reference, such as, for example, the earth, using, for example, latitude and longitude. The speaker locations 112 may also include orientation data of the speakers. The speakers may be located anywhere in an environment. In at least some embodiments, the speakers can be arranged in a space with the intent to create particular kinds of audio immersion. Example configurations for different audio immersion may include ceiling mounted speakers to create an overhead sound experience, wall mounted speakers for a wall of sound, a speaker distribution around the wall/ceiling area of a space to create a complete volume of sound. If there is a subfloor under the floor where people may walk, speakers may also be mounted to or within the subfloor.

The sensor information 114 may include location information of one or more sensors in an audio system. The location information of the sensor information 114 may be the same as or similar to the location information of the speaker locations 112. Further, the sensor information 114 may include information regarding the type of sensors, for example the sensor information 114 may include information indicating that the sensors of the audio system include a sound sensor, and a light sensor. Additionally or alternatively the sensor information 114 may include information regarding the sensitivity, range, and/or detection capabilities of the sensors of the audio system. The sensor information 114 may also include information about an environment or room in which the audio signal generator 100 may be located. For example, the sensor information 114 may include information pertaining to wall locations, ceiling locations, floor locations, and locations of various objects within the room (such as tables, chairs, plants, etc.). In at least some embodiments, a single sensor device may be capable of sensing any or all of the sensor information 114.

The speaker acoustic properties 116 may include information about one or more speakers of the audio system, such as, for example, a size, a wattage, and/or a frequency response of the speakers.

The environmental acoustic properties 118 may include information about sound or the way sound may propagate in the environment. The environmental acoustic properties 118 may include information about sources of sound from outside environment, such as, for example, a part of the environment that is open to the outside, or a street or a sidewalk. The environmental acoustic properties 118 may include information about sources of sound within the environment, such as, for example, a fountain, a fan, or a kitchen that frequently includes sounds of cooking. Additionally or alternatively environmental acoustic properties 118 may include information about the way sound propagates in the environment, such as, for example, information about areas of the environment including walls, tiles, carpet, marble, and/or high ceilings. The environmental acoustic properties 118 may include a map of the environment with different properties relating to different sections of the map.

The operational parameters 120 may include factors that may affect the way audio generated by the audio system is propagated in the environment. Additionally or alternatively the operational parameters 120 may include factors that may affect the way that audio generated by the audio system is perceived by a listener in the environment. As such, in some embodiments, the operational parameters 120 may include, the speaker locations 112, the sensor information 114, the speaker acoustic properties 116, and/or the environmental acoustic properties 118.

Additionally or alternatively, the operational parameters 120 may be based on the speaker locations 112, the sensor information 114, the speaker acoustic properties 116, and/or the environmental acoustic properties 118. For example, the relative positions of the speakers with respect to each other as indicated by the speaker locations 112 may indicate how the individual sound waves of the audio projected by the individual speakers may interact with each other and propagate in the environment. Additionally or alternatively, the speaker acoustic properties 116 and the environmental acoustic properties 118 may also indicate how the individual sound waves of the audio projected by the individual speakers may interact with each other and propagate in the environment. Similarly, the sensor information 114 may indicate conditions within the environment (e.g. presence of people, objects, etc.) that may affect the way the sound waves may interact with each other and propagate throughout the environment. As such, in some embodiments, the operational parameters 120 may include the interactions of the sound waves that may be determined. In these or other embodiments, the interactions included in the operational parameters may include timing information (e.g., the amount of time it takes for sound to propagate from a speaker to a location in the environment such as to another speaker in the environment), echoing or dampening information, constructive or destructive interference of sound waves, etc.

Because the operational parameters 120 may include factors that affect the way audio generated by the audio system is propagated in the environment, the audio signal generator 100 may be configured to generate and/or adjust the audio signals based on the operational parameters 120. The audio signal generator 100 may be configured to adjust one or more settings related to generation or adjustment of audio; for example, one or more of a volume level, a frequency content, dynamics, a playback speed, a playback duration, and/or distance or time delay between speakers of the environment.

There may be unique operational parameters 120 for one or more speakers of the audio system. In some embodiments there may be unique operational parameters 120 for each speaker of the audio system. The unique operational parameters 120 for each speaker may be based on the unique location information of each of the speakers represented in the speaker locations 112 and/or the unique speaker acoustic properties 116 of the speakers.

Because the operational parameters 120 may be based on the speaker locations 112 the operational parameters 120 may enable the generation and/or adjustment of audio signals 132 specifically for the positions of the speakers in the environment. Because the generation and/or adjustment of audio signals 132, may be based on the position of the speakers, the speakers may be distributed irregularly through the environment. It may be that there is no set positioning or configuration of speakers required for operation of the audio system. It may be that the speakers can be distributed regularly or irregularly throughout the environment.

Additionally or alternatively, because the operational parameters 120 may be based on the speaker acoustic properties 116, the operational parameters 120 may enable the generation and/or adjustment of audio signals 132 specifically for the speakers of the audio system.

Additionally or alternatively, because the operational parameters 120 may be based on the environmental acoustic properties 118, the operational parameters 120 may enable the generation and/or adjustment of audio signals 132 specifically for the environment. For example, the operational parameters 120 may indicate that a higher volume level may be better for a particular speaker near to the street in the environment. For another example, the operational parameters 120 may indicate that a quiet volume level may be better for a particular speaker in an area of the environment that may cause sound to echo. For another example, a damping of a particular frequency may be better for a particular speaker in a portion of the environment that would cause the particular frequency to echo.

As an example of the way the audio signals 132 may be generated based on the operational parameters 120, the audio signal generator 100 may generate audio signals 132 simulating a fire truck with a blaring siren driving past an environment on one side of the environment. To simulate the fire truck the audio signal generator 100 may generate audio signals 132 including audio data of the siren for only speakers on the one side of the environment. The operational parameters 120 may include speaker locations 112, thus, the audio signal generator 100 may use the operational parameters 120 to determine which audio signals 132 may include audio data of the siren. Additionally or alternatively, the audio signal generator 100 may determine the volume of the audio signals 132 based on the operational parameters 120 such that the volume is the loudest at speakers on the one side of the environment.

Further, to simulate the fire truck driving past the environment, the audio signal generator 100 may generate audio signals 132 including audio data of the siren at different speakers at different times, or sequentially. The operational parameters 120 may include speaker locations 112, thus, the audio signal generator 100 may use the operational parameters 120 to determine the order in which the various audio signals 132 will include the audio data of the siren. To simulate the speed at which the fire truck drives past the environment, audio signal generator 100 may generate audio signals 132 including audio data of the siren for certain durations of time at the various speakers. The operational parameters 120 may include speaker locations 112 which may include separation between speakers, thus, the operational parameters 120 may be used to determine the duration for which each of the various audio signals 132 will include the audio data of the siren. For example, the separation between speakers may be non-uniform, so, to simulate the fire truck maintaining a constant speed, the various audio signals 132 may include the audio data of the siren for different durations of time.

To simulate the fire truck driving past the environment more smoothly, the audio signal generator 100 may generate audio signals 132 including audio data of the siren that gradually increase and/or decrease in volume over time. To simulate the fire truck driving past the environment more smoothly, the audio signal generator 100 may generate the audio signals 132 that maintain what may be perceived as a constant volume level in the environment. The operational parameters 120 may include the speaker acoustic properties 116 and the environmental acoustic properties 118 which may be used to determine appropriate volume levels for the various audio signals 132 to provide the effect of a constant volume. To simulate the fire truck driving past the environment more smoothly, the audio signal generator 100 may generate audio signals 132 including audio data of the siren in such a way that, although various speakers may play the audio data of the siren starting at different times and for different durations, the sound based on the audio data of the siren may sound continuous to a listener in the environment. The operational parameters 120 may include the speaker locations 112 which may be used to determine how to play, adjust, clip, or truncate the audio data of the siren such that the sound based on the audio data of the siren may sound continuous to a listener in the environment.

In some embodiments the audio signal generator 100 may include a playback manager 130 which may include code and routines configured to enable a computing system to perform one or more operations to generate audio signals 132 for speakers in the environment based on operational parameters 120. Additionally or alternatively, the playback manager 130 may be implemented using hardware including a processor, a microprocessor (e.g., to perform or control performance of one or more operations), an FPGA, or an ASIC. In some other instances, the playback manager 130 may be implemented using a combination of hardware and software. In the present disclosure, operations described as being performed by playback manager 130 may include operations that the playback manager 130 may direct a system to perform.

In general, the playback manager 130 may generate audio signals 132 based on the operational parameters 120, the audio data 121, the scene selection 122, the scene data 123, the signal to initiate operation 125, the random numbers 126, and the sensor output signal 128.

The playback manager 130 may be configured to generate unique audio signals 132 that are unique to each of one or more speakers of the audio system. As described above, the unique audio signals 132 may be based on unique operational parameters 120.

As an example of the playback manager 130 generating audio signal 132 based on the unique operational parameters 120, an example audio data 121 may include a data stream including multiple channels. For example, the data stream may include four channels of recorded audio from four different microphones in a recording environment. The playback manager 130 may relate the four channels of recorded audio to speakers in the environment based on the relative locations of the microphones in the recording environment, and the speaker locations 112 as represented in the unique operational parameters 120. Based on the relationship between the four channels of recorded audio and the speakers in the environment the playback manager 130 may generate audio signal 132 for the speakers in the environment. For example, the audio system may include six speakers. The playback manager 130 may compose the four channels of recorded audio into six audio signal 132 by including audio from one or more channels of recorded audio into each audio signal 132.

The playback manager 130 may be configured to generate the audio signals 132 based on the audio data 121. The audio data 121 may include any data capable of being translated into sound or played as sound. The audio data 121 may include digital representations of sound. The audio data 121 may include recordings of sounds or synthesized sounds. The audio data 121 may include recordings of sounds including for example birds chirping, birds flying, a tiger walking, water flowing, waves crashing, rain falling, wind blowing, recorded music, recorded speech, and/or recorded noise. The audio data 121 may include altered versions of recorded sounds. The audio data 121 may include synthesized sounds including for example synthesized noise, synthesized speech, or synthesized music. The audio data 121 may be stored in any suitable file format, including for example Motion Picture Experts Group Layer-3 Audio (MP3), Waveform Audio File Format (WAV), Audio Interchange File Format (AIFF), or Opus.

The playback manager 130 may include the audio data 121 in the audio signals 132. The playback manager 130 may select audio data 121 from the audio data 121 and, include the selected audio data 121 in the audio signals 132.

In some embodiments the generation of audio signals 132 may include translating the audio data 121 from one format into the format of the audio signals 132. For example the audio data 121 may be stored in a digital format; and thus, the generation of audio signals 132 may include translating the audio data 121 into another format, such as, for example, an analog format.

In some embodiments the generation of audio may include combining multiple different audio data 121 into a single audio signal 132. For example, the playback manager 130 may combine audio data 121 of a bird chirping with audio data 121 of ocean waves crashing to generate an audio signal 132 including sounds of ocean waves crashing and the bird chirping to be played at the same time, or overlapping.

In some embodiments the audio data 121 may include a data stream. The data stream may include a stream of data that is capable of being played at a speaker at, or about the time, the data stream is received. In some embodiments the data stream may be capable of being buffered.

The audio data 121 may be captured by a remote capture device (e.g., microphone). The remote capture device may include a set of microphones, a local processor, and network connection (e.g., WiFi, Ethernet, LTE). The remote capture device may capture audio in one or more formats (e.g. mono, stereo, ambisonics), compress the audio, encode the audio in any format (e.g., Opus format), and stream the audio to a web-based service. In at least some embodiments, the web-based service may include a quality control component that may be used to audit the audio stream from the remote capture device for quality and either accept the audio stream it as presented or make suggestions for what needs to be done to make the stream be of acceptable quality.

In some embodiments the data stream may be from a microphone contemporaneously recording the data stream in another location. For example one or more microphones in the Grand Canal in Venice, Italy may record a data stream. The data stream from the Grand Canal in Venice, Italy may be included in audio data 121. Then, the audio data 121 including the data stream from the Grand Canal in Venice, Italy, may be included in the audio signals 132, which may in turn be played by an audio system which may be, for example, in the United States.

In some embodiments the data stream may include a time-delayed recording from another environment. For example, the data stream may include a time-delayed version of the data stream from the Grand Canal in Venice, Italy. For example, the audio signals 132 may include a time-delayed data stream such that the time of recording correlates to the playback time. For example, at 8:00 PM in the location of the audio system, the playback manager 130 may include the data stream from the Grand Canal in Venice, Italy that was recorded at 8:00 PM in Venice in the audio signals 132. For another example, the playback manager 130 may include the data stream in the audio signals 132 months after it was recorded. For example an Italian-restaurant owner may favor a data stream from May in Venice; thus, the restaurant owner may configure the audio signals 132 to include the data stream from May in Venice in the audio signals 132, during November.

In some embodiments the audio data 121 may include multiple channels. In some embodiments the audio data 121 may include recordings of the same thing from one or more different microphones. For example the audio data 121 may include recorded sounds from a beach as recorded at multiple different locations on the beach. In some embodiments the audio data 121 may include simulated, or adjusted data that may represent different channels. For example the audio data 121 may include synthesized sounds, which may include sounds synthesized as if they were being recorded from different locations. Additionally or alternatively the audio data 121 may include different audio channels for different frequency bands.

In some embodiments the audio data 121 may include data recorded by a 3D microphone. In some embodiments the audio data 121 may include data recorded specifically for playback in the environment.

The audio data 121 may be categorized into multiple categories. The audio data 121 may be tagged or may include metadata. Additionally or alternatively the audio data 121 may be stored in a database based on the categories.

In some embodiments, the audio data 121 may include third-party data provided by another service. For example, the audio data 121 may include a stream of audio data. In these or other embodiments, the stream of audio data may be included in the audio data and may be included in one or more audio signals. In some instances the one or more settings of the stream of audio data may be adjusted for the speakers and/or for the environment. For example, the playback of the data stream at a first speaker may start at a first time, the playback at a second speaker may be delayed by a time interval. The time interval may be based on the distance between the speakers or the distance between the speakers and a predetermined location. For example, the time interval may be based on synchronization. For instance, the first speaker may begin playback the stream of audio data at a first time, and the second speaker may begin playback of the stream of audio data at a second time. The time interval between the first time and the second time may be calculated based on the difference between the distance between the first speaker and a predetermined location, (for example the center of where listeners may be expected to be found), and the distance between the second speaker and the predetermined location.

The scene selection 122 may include an indication of a scene which may be selected from a list of available scenes. The scene data 123 may include information regarding the scene. The scene data 123 may include audio data, which may include audio data related to the scene. The audio data may be the same as, or similar to the audio data 121 described above. In the present disclosure, references to audio data 121 may also refer to audio data included in the scene data 123. Additionally or alternatively the scene data 123 may include categories of audio data related to the scene. Examples of scenes may include a beach scene, a jungle scene, a forest scene, an outdoor park scene, a sports scene, or a city scene, for example, Venice, Paris, or New York City. Additionally or alternatively scenes may be related to a movie, or a book, for example a STAR WARS® theme. The scene selection 122 may be an indication to the playback manager 130 of which scene data 123 to obtain for further use in generating the audio signals 132.

The audio signal generator 100 may use a network connection to fetch one or more scene data 123 to be played in a space. The scene data 123 may include a scene description and audio content. In addition, a web-based service (not illustrated in FIG. 1) may send control signals to audio signal generator 100 to change or control the scene that is being played. Additionally or alternatively, the control signals can come from applications or commands on remote computers, phones or tablets. Software running on the audio signal generator 100 can also be updated via the network connection.

The scene data 123 may further include one or more virtual environments, simulated objects, location properties, sound properties, and/or behavior profiles. Virtual environments will be described more fully with regard to FIG. 5. Virtual environments of the scene data 123 may further include one or more simulated objects. Simulated objects will be described more fully with regard to FIG. 5. The simulated objects of the scene data 123 may include location properties, sound properties, and behavior profiles. Location properties, sound properties, and behavior profiles will be described more fully with regard to FIGS. 5 and 6.

For example, a scene selection 122 may indicate a scene of a New York City street. The scene data 123 of the New York City street may include audio data including car horns, sounds of buses, or sounds of a subway. The scene data 123 of the New York City street may include one or more virtual environments such as, for example, a nighttime environment, a downtown Manhattan environment, or an environment near a subway station. The scene data 123 may include one or more simulated objects, which may be related to the virtual environments, such as, for example, a simulated bus, a simulated group of people talking indistinctly, or a simulated fire truck. The simulated objects may have location properties, sound properties and behavior profiles. For example, a simulated fire truck may have location properties which may be related to a virtual environment. The simulated fire truck may have audio data including siren sounds and horn sounds. The simulated fire truck may have a behavior profile that indicates the speed of the simulated fire truck, the frequency, and/or probability that the simulated fire truck will enter the virtual environment. The playback manager 130 may include the audio data in the audio signals 132.

The signal to initiate operation 125 may include a signal instructing the audio system to initiate operation or the generation of audio in the environment. The playback manager 130 may begin generating the audio signals 132 in response to receiving the signal to initiate operation 125.

The random numbers 126 may be random, or pseudo-random numbers from any suitable source. For example, the random numbers may include random, or pseudo-random numbers based on an algorithm, or measurements of physical phenomena such as, for example atmospheric noise or thermal noise. The random numbers 126 may be generated at the audio system, additionally or alternatively the random numbers 126 may be obtained from another source, such as, for example random.org.

The sensor output signal 128 may be one or more signals generated by one or more sensors of the audio system. The sensor output signal 128 may be based on the type of sensor generating the sensor output signal 128. For example, a sound sensor may generate a sensor output signal 128 relating to sound. The sensor output signal 128 may be an indication of a condition. Additionally or alternatively the sensor output signal 128 may be information relating to a condition. For example, the sensor output signal 128 may indicate that the environment is "occupied." Additionally or alternatively the sensor output signal 128 may indicate a number, or an approximate number of people in the environment.

The audio signals 132 may include one or more signals configured to provide audio when output by a speaker. The audio signals 132 may include analog or digital signals. The audio signals 132 may be of sufficient voltage to be output by speakers, additionally or alternatively the audio signals 132 may be of insufficient voltage to be output by speakers without being amplified.

In some embodiments the playback manager 130 may be configured to generate the audio signals 132. As described above, when the playback manager 130 generates the audio signals 132, the audio signals 132 may be based on the operational parameters 120.

As described above, the playback manager 130 may select particular audio data from the audio data 121 to include in the audio signals 132. The playback manager 130 may select the particular audio data based on the scene selection 122. For example, the particular audio data may be audio data related to the scene selection 122. For another example the particular audio data may be of the same category as the scene selection 122, or the particular audio data may be included in the scene data 123.

In some embodiments the playback manager 130 may select the particular audio data for inclusion in the audio signals 132 based on the random numbers 126. For example, the particular audio data included in the audio signals 132 may be selected at random, which may mean based on the random numbers 126, from a subset of the audio data 121 that is related to the scene selection 122, or that is part of the scene data 123.

In some embodiments the playback manager 130 may be configured to adjust the audio signals 132. In some embodiments the playback manager 130 may adjust the audio signals 132 by ceasing to include some audio data in the audio signals 132. In these or other embodiments the playback manager 130 may adjust the audio signals 132 by including some other audio data in the audio signals 132 that was not previously in the audio signals 132. For example, the audio signals 132 may include audio data including sounds of birds singing. Later, the playback manager 130 may cease including audio data of sounds of the birds singing in the audio signals 132 and start including sounds of birds taking flight in the audio signals 132. Changing which audio data is included in the audio signals 132 may be an example of generating dynamic audio.

In some embodiments the playback manager 130 may adjust the audio signals 132 by changing one or more settings, including a volume level, a frequency content, dynamics, a playback speed, or a playback duration of the audio data in the audio signal. For example, the playback manager 130 may adjust the volume level of audio data 121 in the audio signals 132. Additionally or alternatively the playback manager 130 may adjust settings of the audio signals 132. Adjusting the audio signals 132, or the particular audio data included in the audio signals 132 may be an example of the audio system generating dynamic audio.

In some embodiments the playback manager 130 may adjust the audio signals 132 based on the random numbers 126. For example to avoid repetition, the playback manager 130 may select the particular audio data to include in the audio signals 132 at any particular time based on the random numbers 126. Additionally or alternatively the time at which the particular audio data is included in the audio signals 132 may be based on the random numbers 126. For example the particular audio data may be included in the audio signals 132 at random times, or repeated at random or pseudo-random intervals. For example the playback manager 130 may be configured to include first audio data of a first toucan call in the audio signals 132 at a first time. After an interval of time based on the random numbers 126, the playback manager 130 may be configured to select second audio data of a second toucan call based on the random numbers 126 from a group of audio data of toucan calls. Then the playback manager 130 may be configured to include the second audio data in the audio signals 132.

Additionally or alternatively the playback manager 130 may be configured to adjust settings of the audio data based on the random numbers 126. For example, the playback manager 130 may adjust the frequency content of audio data of a toucan call based on the random numbers 126. Adjusting the audio data for inclusion in the audio signals 132 based on the random numbers 126 may result in audio signals 132 that may not be repetitive.

Additionally or alternatively the playback manager 130 may adjust or adjust the audio signals 132 based on the sensor output signal 128. In some embodiments, the audio system may include one or more sensors configured to measure, detect, sense or otherwise take a reading. The reading may indicate a condition of the environment. The one or more sensors may be configured to produce a sensor output signal 128. The sensor output signal 128 may include the indication of the condition of the environment, or information related to the condition of the environment, such as, for example, one or more readings of the one or more sensors.

Examples of conditions of the environment include an ambient sound level in the environment, the presence of a person in the environment, a light level in the environment, temperature in the environment, and/or humidity in the environment. Additionally or alternatively, the condition may be a general condition, not related to the environment, for example time, or weather. Further, the conditions may be local to a sensor, for example a sensor may detect an ambient sound level at the sensor, the presence of a person near the sensor, a light level at the sensor, the temperature at the sensor, or the humidity at the sensor.

For example, an occupancy sensor may indicate in the sensor output signal 128, that the environment has become "occupied." In response to the sensor output signal 128, the playback manager 130 may cease to include audio data of sounds of the birds singing in the audio signals 132 and instead include audio data of sounds of bird taking flight in the audio signals 132. In another example, detecting a presence input can inform the experience of motion, entry and exit of people/objects within a space. In at least some embodiments, the audio signal generator 100 may be able to distinguish between spaces with a few people and spaces with many people. The nature of and/or the equalization of the sound being produced by the audio signal generator 100 could be altered based on how full the space may be. In another example, the audio signal generator 100 may alter a scene as the space goes between light and dark. In a further example, by listening to what is happening in a space and understanding the difference between the actual sound and the sound being produced by the audio signal generator 100, a number of adjustments could be made to the sound as it is generated including equalization and dynamic volume adjustment.

In at least some embodiments, the sensor output signal 128 may include weather data, which may be received from a local weather sensor and/or a remote weather sensor or service. In at least some embodiments, weather at another location could be distilled into a set of properties that are then injected into a scene so that specific audio is played for certain weather conditions. In at least some embodiments, the sensor output signal 128 may include a real world data set. For example, data from an external source could be used to steer sound objects through a space for an audible representation of data. In this manner, the on goings in a first space may control or influence an experience in a second space. In another example, the sensor output signal 128 may include time to trigger events to take place and alter a virtual environment as time passes. In yet another example, the sensor output signal 128 may include voice control. Voice commands may be sent by a web-based service into spaces and by association scenes if the sensor output signal 128 deems that the voice command may be handled by the scene.

Modifications, additions, or omissions may be made to the audio signal generator 100 without departing from the scope of the present disclosure. For example, the audio signal generator 100 may include only the configuration manager 110 or only the playback manager 130 in some instances. In these or other embodiments, the audio signal generator 100 may perform more or fewer operations than those described. In addition. The different input parameters that may be used by the audio signal generator 100 may vary.

Figure 2:
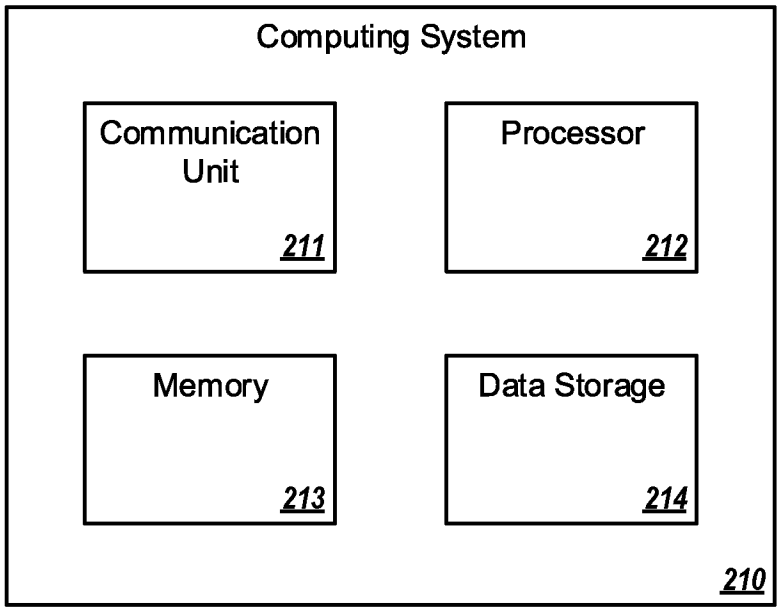
FIG. 2 is a block diagram of an example computing system.

FIG. 2 is a block diagram of an example computing system 210; which may be arranged in accordance with at least one embodiment described in this disclosure. As illustrated in FIG. 2, the computing system 210 may include a processor 212, a memory 213, a data storage 214, and a communication unit 211.

Generally, the processor 212 may include any suitable special-purpose or general-purpose computer, computing entity, or processing device including various computer hardware or software modules and may be configured to execute instructions stored on any applicable computer-readable storage media. For example, the processor 212 may include a microprocessor, a microcontroller, a digital signal processor (DSP), an ASIC, an FPGA, or any other digital or analog circuitry configured to interpret and/or to execute program instructions and/or to process data. Although illustrated as a single processor in FIG. 2, it is understood that the processor 212 may include any number of processors distributed across any number of network or physical locations that are configured to perform individually or collectively any number of operations described herein.

In some embodiments, the processor 212 may interpret and/or execute program instructions and/or process data stored in the memory 213, the data storage 214, or the memory 213 and the data storage 214. In some embodiments, the processor 212 may fetch program instructions from the data storage 214 and load the program instructions in the memory 213. After the program instructions are loaded into the memory 213, the processor 212 may execute the program instructions, such as instructions to perform one or more operations described with respect to the audio signal generator 100 of FIG. 1.

The memory 213 and the data storage 214 may include computer-readable storage media or one or more computer-readable storage mediums for carrying or having computer-executable instructions or data structures stored thereon. Such computer-readable storage media may be any available media that may be accessed by a general-purpose or special-purpose computer, such as the processor 212. By way of example, and not limitation, such computer-readable storage media may include non-transitory computer-readable storage media including Random Access Memory (RAM), Read-Only Memory (ROM), Electrically Erasable Programmable Read-Only Memory (EEPROM), Compact Disc Read-Only Memory (CD-ROM) or other optical disk storage, magnetic disk storage or other magnetic storage devices, flash memory devices (e.g., solid state memory devices), or any other storage medium which may be used to carry or store desired program code in the form of computer-executable instructions or data structures and which may be accessed by a general-purpose or special-purpose computer. Combinations of the above may also be included within the scope of computer-readable storage media. Computer-executable instructions may include, for example, instructions and data configured to cause the processor 212 to perform a certain operation or group of operations.

In some embodiments the communication unit 211 may be configured to obtain audio data and to provide the audio data to the data storage 214. Additionally or alternatively the communication unit 211 may be configured to obtain locations of speakers, and to provide the locations of the speakers to the data storage 214. Additionally or alternatively the communication unit 211 may be configured to obtain locations of sensors, and to provide the locations of the sensors to the data storage 214. Additionally or alternatively the communication unit 211 may be configured to obtain acoustic properties of the speakers, and to provide the acoustic properties of the speakers to the data storage 214. Additionally or alternatively the communication unit 211 may be configured to obtain acoustic properties of an environment, and to provide the acoustic properties of the environment to the data storage 214. Additionally or alternatively the communication unit 211 may be configured to obtain a selection of a scene, and to provide the selection of the scene to the data storage 214. Additionally or alternatively the communication unit 211 may be configured to obtain a signal to initiate operation, and to provide the signal to initiate operation to the data storage 214. Additionally or alternatively the communication unit 211 may be configured to obtain a random number, and to provide the random number to the data storage 214. Additionally or alternatively the communication unit 211 may be configured to obtain a sensor output signal, and to provide the sensor output signal to the data storage 214. Additionally or alternatively the communication unit 211 may be configured to obtain scene information, and to provide the scene information to the data storage 214.

Modifications, additions, or omissions may be made to the computing system 210 without departing from the scope of the present disclosure. For example, the data storage 214 may be located in multiple locations and accessed by the processor 212 through a network.

Figure 3:
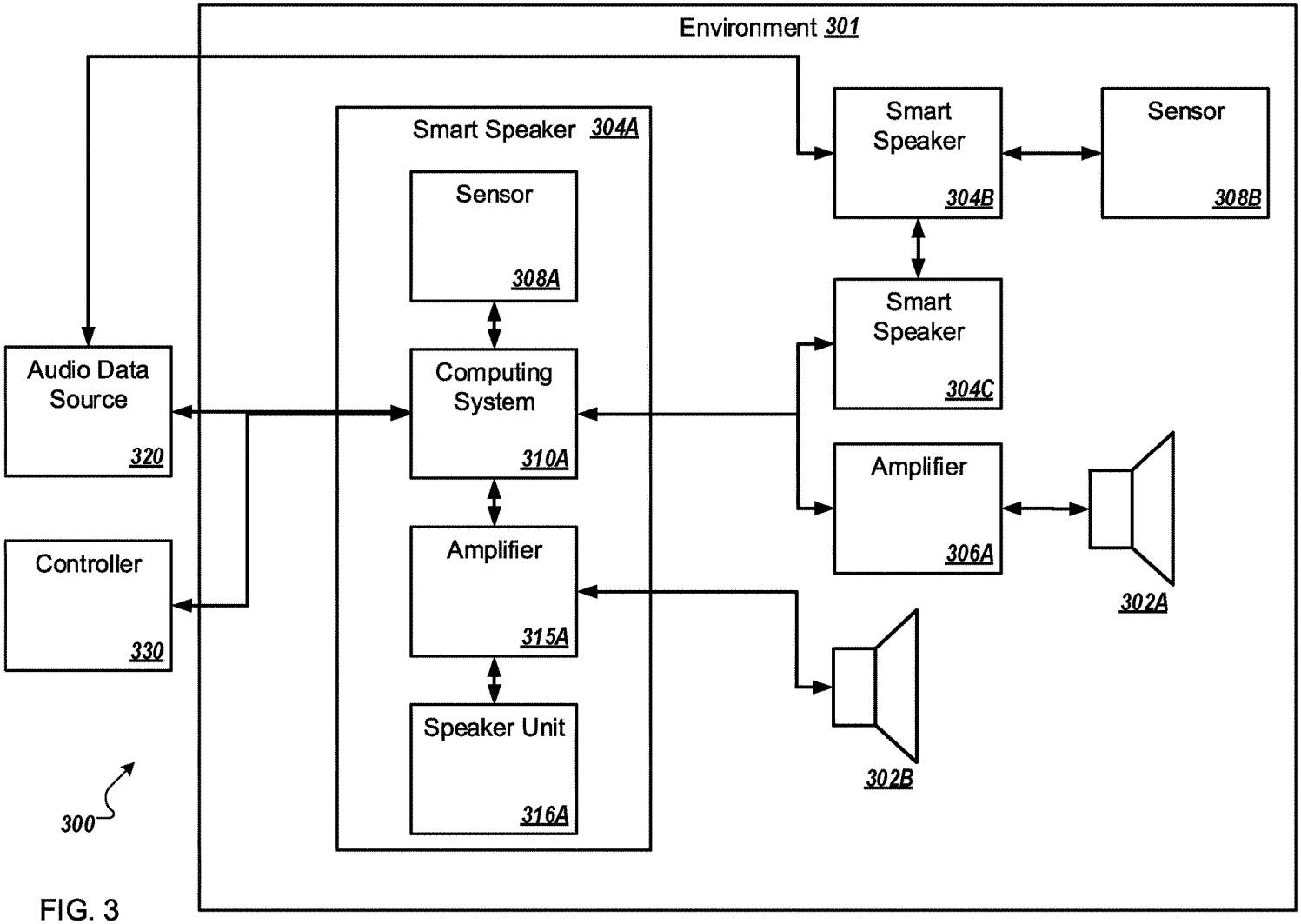
FIG. 3 is a block diagram of an example audio system configured to generate dynamic audio in an environment.

FIG. 3 illustrates a block diagram of an example audio system 300 configured to generate dynamic audio in an environment 301 arranged in accordance with at least one embodiment described in this disclosure. The audio system 300 may include one or more smart speakers 304, one or more sensors 308, an audio data source 320, and a controller 330. Three smart speakers are illustrated in FIG. 3: first smart speaker 304A, second smart speaker 304B, and third smart speaker 304C (collectively referred to as smart speakers 304 and/or individually referred to as smart speaker 304). Two sensors are illustrated in FIG. 3: first sensor 308A, and second sensor 308B (collectively referred to as sensors 308 and/or individually referred to as sensor 308). However, the number of speakers and sensors may vary according to different implementations.

One or more of the smart speakers 304 may include a computing system 310A. The computing system 310A may be the same as or similar to the computing system 210 of FIG. 2. The computing system 310A may be configured to control operations of the one or more smart speakers 304 of the audio system 300 such that the audio system 300 may generate dynamic audio in the environment 301. The computing system 310A may include an audio signal generator similar or analogous to the audio signal generator 100 of FIG. 1 such that the computing system 310A may be configured to implement one or more operations related to the audio signal generator 100 of FIG. 1.

In the present disclosure, reference to the audio system 300 performing operations may include operations performed by the any element of the audio system 300. For example, reference to the audio system 300 performing an operation may include performance of that operation by one or more smart speakers 304. For example, generation of an audio signal by a particular smart speaker 304 may be referred to as the audio system 300 generating an audio signal. For another example, one or more smart speakers 304 providing audio based on an audio signal may be referred to as the audio system 300 providing audio. In addition, reference to the audio system 300 performing an operation may include operations that may be dictated or controlled by an audio signal generator such as the audio signal generator 100 of FIG. 1.

In general, the smart speakers 304 may be configured to receive audio data from the audio data source 320. The smart speakers 304 may be configured to generate one or more audio signals from the audio data. The generation of the audio signal may include generating audio and/or adjusting the audio data according to one or more of the characteristics of the smart speakers 304, the position of the smart speakers 304 in the environment 301, and/or attributes of the environment 301 itself. Further the generation of the audio signal may include combining more than one audio data into the audio signal. Each of the smart speakers 304 may be configured to generate its own audio signal. The smart speakers 304 may be configured to play the audio signals. The audio system 300 may further include one or more sensors 308 in the environment 301. The smart speakers 304 may be further configured to adjust the audio signals based on a condition of the environment 301 that has been detected by the sensors 308. Additionally or alternatively, the smart speakers 304 may be configured to adjust the audio signals based on random numbers. The smart speakers 304 may be configured to play the adjusted audio signals. By adjusting audio signals and playing adjusted audio signals, the audio system 300 may be generating dynamic audio in the environment 301.

The environment 301 may include any environment that could be augmented with an audio system. Examples of the environment 301 include a restaurant, a museum, a hotel lobby, a hotel room, a retail location, a library, a hospital room, a hospital lobby, a hallway, a sports bar, an office building, an office, a house, a room of a house, or an outdoor space.

In some embodiments the audio system 300 may include smart speakers 304. Each of the smart speakers 304 may include the elements illustrated and described with respect to smart speaker 304A. The smart speaker 304A may include a computing system 310A, an amplifier 315A, a speaker unit 316A, and/or a sensor 308A.

The computing system 310A may be configured to send communications to, and receive communications from the audio data source 320. In particular, the computing system 310A may be configured to receive the audio data from the audio data source 320. The computing system 310A may be configured to communicate with the audio data source 320 across a computer network, such as, for example, the Internet, a (Local Area Network) LAN or a (Wide Area Network) WAN.

The computing system 310A may be further configured to send communications to, and receive communications from the controller 330. The computing system 310A may communicate with the controller 330 through a computer network, such as, for example, the Internet, a LAN, or a WAN. Additionally or alternatively, the computing system 310A may communicate with the controller 330 directly through any suitable wired or wireless technique, such as, for example, infrared (IR) communications, wireless Ethernet such as, for example, Institute of Electrical and Electronics Engineers (IEEE) 802.11, or Bluetooth. Alternately or additionally, the network may include one or more cellular (radio frequency) RF networks and/or one or more wired and/or wireless networks such as, but not limited to, 802.xx networks, Bluetooth access points, wireless access points, Long Term Evolution (LTE) or LTE-Advanced networks, IP-based networks, or the like. The network may also include servers that enable one type of network to interface with another type of network.

The computing system 310A may be further configured to enable the smart speakers 304 to communicate with other smart speakers 304. The smart speakers 304 may be configured to communicate through a computer network, such as, for example, the internet, a LAN, or a WAN. Additionally or alternatively, the smart speakers 304 may be configured to communicate directly through any suitable wired or wireless technique, such as, for example, IR communications, wireless Ethernet, or Bluetooth. In some embodiments the smart speakers 304 may be configured to form a computer network using any suitable network architecture. For example, the smart speakers 304 may form a tree network, a ring network, or a peer-to-peer network.

In some embodiments the smart speaker 304A may include the amplifier 315A. The amplifier 315A may be configured to amplify the audio signal such that it is of a suitable voltage to be played by the speaker unit 316A. The amplifier 315A may include any suitable device for amplification.

In some embodiments the smart speaker 304A may include the speaker unit 316A. The speaker unit 316A may include a speaker capable of providing audio based on an audio signal, or amplified audio signal. The speaker unit 316A may be of any suitable size and/or wattage. In some embodiments the speaker unit 316A may include multiple speakers. For example, the speaker unit 316A may include a speaker configured for lower frequency sounds and another speaker for higher frequency sounds.

In some embodiments the smart speaker 304A may include the sensor 308A. The sensor 308A may be an example of a sensor 308. The sensor 308 may measure, detect, sense or otherwise take a reading. The reading may indicate a condition of the environment 301. The sensor 308 may be configured to produce a sensor output signal, such as, for example, the sensor output signal 128 of FIG. 1. The sensor output signal may include the indication of the condition of the environment, or information related to the condition of the environment, such as, for example, the readings of the sensors 308. Additionally or alternatively, the sensor output signal may include information based on the readings of the sensors 308. For example, the sensor output signal may include an indication of a number of people in the environment 301, which may include a range, or an estimate. For another example, the sensor output signal may include locations of one or more people in the environment 301.

The sensors 308 may include a sound sensor, a microphone, an occupancy sensor, a motion detector, a heat detector, a thermal camera, a pressure sensor, a scale, a vibration sensor, a light sensor, a motion detector, a camera, a temperature sensor, a thermometer, a humidity detector, a weather sensor, a barometric pressure sensor, an anemometer, a time sensor, or a clock.

In some embodiments the audio system 300 may include sensors 308 all configured to detect the same category of condition, for example, all sensors 308 may be configured to detect sound. Additionally or alternatively the audio system 300 may include multiple sensors configured to detect different categories of conditions. For example, the audio system 300 may include sensors 308 configured to detect sound and sensors 308 configured to detect occupancy. In some embodiments a single smart speaker 304 may include multiple sensors 308A configured to detect different categories of conditions.

In some embodiments, any or all of the elements of the smart speaker 304A, including the sensor 308A, the computing system 310A, the amplifier 315A, and/or the speaker unit 316A, may be communicatively coupled. The communicative coupling may allow the elements to communicate. The communicatively coupling may be wired or wireless. Additionally or alternatively, the communicatively coupling may be through a bus or a backplane.

In some embodiments the audio system 300 may include the sensor 308B. The sensor 308B may be the same or similar as the sensor 308A. In some embodiments the sensor 308B may communicate with one or more of the smart speakers 304. The sensor 308B may be configured to communicate with the smart speakers 304 through any suitable wired or wireless technique, such as, for example, IR communications, wireless Ethernet, or Bluetooth.

In some embodiments the audio system 300 may include the audio data source 320. The audio data source 320 may include any suitable device for storing audio data. The audio data stored by the audio data source 320 may be the same as or similar to the audio data 121 of FIG. 1. The audio data source 320 may include a computing system, such as, for example, the computing system 210 of FIG. 2. The audio data source 320 may include a server, or a database. In some embodiments the audio data source 320 may be near the environment 301. In these or other embodiments the smart speakers 304 may communicate directly with the audio data source 320 through any suitable wired or wireless technique. In some embodiments the audio data source 320 may be part of the same LAN as the smart speakers 304. Additionally or alternatively the audio data source 320 may be distant from the environment 301. In these or other embodiments the smart speakers 304 may communicate with the audio data source 320 through a computer network, such as, for example, a WAN or the internet. In some embodiments the audio data source 320 may include multiple computers or servers. In some embodiments the audio data source 320 may include multiple computers or servers distributed across multiple disparate locations.

The audio data may be stored on the audio data source 320 according to categories. For example the audio data source 320 may store hundreds of thousands of audio data categorized as "bird sounds." Further the audio data source 320 may store tens of thousands of audio data categorized as "sea bird sounds." Further the audio data source 320 may store thousands of audio data categorized as "California seagull sounds." Further the audio data source 320 may store hundreds of audio data categorized as "seagull squawking sounds."

The smart speakers 304 may be configured to download, or stream audio data from the audio data source 320. Downloading or streaming audio data may both be examples of the smart speakers 304 receiving data from the audio data source 320.

As discussed above, embodiments may use more than one smart speaker. For ease in explanation, a system with three smart speakers 304A, 304B, and 304C are described with the understanding that any number of smart speakers 304 may be used.

A computation to generate a sound waves emitted by the speakers may happen on local processors on each of the smart speakers 304A, 304B, and 304C. Each of the processors knows which speaker it is associated with and the positions of all of the speakers within the environment 301. With this information and with a script that may control or influence how an audio experience is orchestrated within the environment 301, each of the smart speakers 304A, 304B, and 304C can compute the particular contribution that the respective speaker may output to make at each moment in time to project the audio experience into the environment 301.

To project sounds into the environment 301, the smart speakers 304A, 304B, and 304C may play sounds that may contribute to the audio experience in such a way that the sounds arrive in the environment 301 at a particular location at a particular time. To accomplish this, the smart speakers 304A and 304B may be time synchronized. To that end, each of the smart speakers 304A and 304B may also influence or control scene execution at or near a time synchronized manner. For example the scenes may contain sound objects that move with behaviors defined either in a simple declarative manner, a hybrid declarative and software scripted manner, or under fully scripted control. Scenes and sound objects within the scenes may include input and output parameters that allow for a dataflow to occur in to, out of and throughout the collection of objects that make up a scene.

A sound object may include a local coordinate space with sounds at positions relative to that local coordinate space. Sound objects can be organized into hierarchies with sub-objects. Each sound object can also have an associated set of scripts that may define behaviors for the sound object. These behaviors may generate motion paths that govern how the object moves in the coordinate system, such as when to move and how to select from a potential set of sounds emitted by the object, among others.

Example adjustable sound object properties may include name, transform, position, orientation, volume, mute, priority, bounds, path, type (linear, curve, circle, scripted), velocity, mass, acceleration, points, orient, loop, delay, motion, among others.

Scripts may be expressed in various formats, such as Lua, and may be used to create behaviors more sophisticated than simply motion along a path. Scripts may also be used to handle incoming or outgoing data through the environment. Different scripts may be called at different times. In at least one embodiment, scripts may use a shared variable space. Having a shared space may allow scripts that execute at different times—and potentially for different purposes—to exchange information through the shared variables. Scripts, for example, can reference objects and the scene via a dotted namespace. Further, each speaker may include a local script engine to execute one or more scripts. Additionally or alternatively, two or more speakers may include a distributed script engine that is distributed among the two or more speakers. Whether local or distributed, the script engine(s) may control audio output within the environment.

Scenes, sound objects and audio streams may be referenced via standard Internet Uniform Resource Locators (URLs), which enables these references to be stored on a Web Server. Real time or near-real time continuous audio streams may also be referenced using URLs.

In some embodiments the audio system 300 may include the controller 330. The controller 330 may be configured to communicate with the audio system 300. The controller 330 may be configured to initiate operation of the audio system 300. For example the controller 330 may be configured to cause the audio system 300 to begin generating audio. The controller 330 may be further configured to allow a person to interact with the audio system 300. For example the controller 330 may be configured to allow the person to control one or more aspects of the audio being generated by the audio system 300. For example, the person may be able to control the volume of the audio system 300 through the controller 330. Additionally or alternatively the person may be able to control the volume of a particular speaker 302, or a group of particular speakers 302.

In some embodiments the controller 330 may include any device which may be configured to communicate with the smart speakers 304. For example, the controller 330 may include a remote control, a smart phone, a tablet, a laptop, or another computing system that may be configured to communicate with the computing system 310. In some embodiments the controller 330 may include an interface of part of the audio system 300. For example the smart speakers 304 may include an interface through which a user may interact with the audio system 300. The interface may be as simple as a Light Emitting Diode (LED) or Liquid Crystal Display (LCD) display and one or more buttons. Additionally or alternatively the interface may include a touch screen, or a display and mouse and/or keyboard.

The controller 330 may be configured to perform various tasks and operations. For example, the controller 330 may be used to initiate a space characterization process, as further described in conjunction with FIG. 5. The controller 330 may also be used for scene staging and loading a stored scene into a space. For example, a scene may be initiated using a mobile application and a play button and/or a "stream to" button. The controller 330 may be used for scene editing, such as making adjustments to a scene, adding objects to a scene, etc. The controller 330 may be used for scene startup, control and monitoring. For example, once a scene has been loaded, the controller 330 may be used to start an audio "simulation", stop the audio simulation, adjust real time parameters (e.g. volume), etc. The controller 330 may also be used to access a content store for browsing and/or purchasing scenes or objects for insertion into a scene.

The service may include a system to manage a list of scenes. The service may also provide a store front for customer access to pick (or purchase) a scene, and then download the scene to their collection of scenes. The service may also include a content portal for scene providers to give scene upload access to other users, analytics on scene usage, scene sales data, etc.

Content providers may record various audio data and may upload the audio data to the service. In at least some embodiments, the content providers may enhance or edit the audio data to create or modify a scene. The service may list the scenes that are provided by the content providers. A customer may identify a scene and download the scene to their audio system. The service may also interface with another service, such as Alexa® from Amazon.com, Inc., or Google Home from Google LLC., in giving commands to the audio system.

In at least some embodiments, the controller 330 may include a service that may influence speaker operation. The service may include a web-based or Internet-based service that may communicate with the speakers via a network. The service may be configured to receive commands from outside source. For example, the service may be configured to receive text-based or voice-based commands to play or change playback of a particular scene. For example, using the service, a user in a space may audibly say to "play a forest scene." The service may use the user's speech to generate a command to initiate playback of the forest scene. The service may cause the comment to initiate playback of the forest scene to be sent to one or more of the speakers 304 and the one or more speakers 304 may begin playback of the forest scene. In another example, the service may use one or more rules to trigger sending various commands to the speakers 304. For example, a time-based rule may trigger the service to send a command to the speakers 304. Any other type of rule may be used, such as a location-based rule, a rule based on sensor data, a user-defined rule, etc. In at least some embodiments, the service may include a gateway to other services. For example, the service may be in communication with a music provider (another service). The music provider may be authorized to push audio data to the service. The service may then push the audio data to the speakers 304. In at least some embodiments, the service may receive audio data with more than one channels of audio. The service may make a decision based upon content frequency, location of the speakers 304 on where to place the one or more channels of audio data.

As an example of the operation of the audio system 300, the audio system 300, which may be comprised of one or more smart speakers 304, may perform one or more operations described below.

The audio system 300 may be configured for operation. The audio system 300 may obtain information regarding the smart speakers 304, the environment 301, and/or the sensors 308. The information may be represented as operational parameters, which may be the same as or similar to the operational parameters 120 of FIG. 1. The audio system 300 may obtain this information from the smart speakers 304, from a user through the controller 330, or from another source. For example, the smart speakers 304 may have information regarding the acoustic properties of the smart speakers 304 a priori. The audio system 300 may use this information to create operational parameters.

In some embodiments, a user may select a scene. The user may communicate the scene to the audio system 300 through the controller 330. The audio system 300 may then obtain audio data related to the scene from the audio data source 320. For example, the user may select an Alpine Mountain Café scene using the controller 330. The audio system 300 may obtain audio data from the audio data source 320 including audio data of cow bells, waterfalls, wind blowing, and/or Alpine horns.

The audio system 300 may then obtain a signal instructing the audio system 300 to initiate playback operation. The user may send the signal instructing the audio system 300 to initiate operation through the controller 330.

The audio system 300 may operate to generate audio in the environment 301. To generate audio in the environment 301, the audio system 300 may select audio data from the audio data that has been obtained and include the audio data in the audio signals of one or more of the smart speakers 304 in the environment 301. The speaker units 316A of the smart speakers 304 may then provide audio based on the audio signals. In some embodiments, the audio system 300 may generate the audio signals in a dynamic manner according to one or more operations described above with respect to FIG. 1. Further, the audio system 300 may provide dynamic audio based on the audio signals.

Additionally, as described above, in some embodiments the generation of audio by the audio system 300 may include including audio data in the audio signal according to the operational parameters, or adjusting the audio data for playback according to the operational parameters. Providing audio according to the operational parameters may constitute providing audio that has been adjusted specifically for the environment and/or for the speakers in the audio system 300.

In some embodiments each of the smart speakers 304 may generate and output its own audio signal. In these or other embodiments each of the smart speakers 304 may download its own audio data, and generate and output its own audio signals. For example, a first group of smart speakers 304 on one side of a large environment 301 may be configured to download audio data related to a jungle scene. The first group of smart speakers 304 may output audio related to the jungle scene. A second group of smart speakers 304 on another side of the large environment 301 may be configured to download audio data related to a beach scene. The second group of smart speakers 304 may output audio related to the beach scene.

In some embodiments the smart speakers 304 may be configured to operate as peers in a peer-to-peer network, a distributed processing network, distributed computing network, or a distributed storage network. For example, the smart speakers 304 may communicate and share audio data that is stored by one or more of the smart speakers 304. For example, one of the smart speakers 304 may download audio data, and share that audio data with its peer smart speakers 304. Additionally or alternatively the smart speakers 304 may communicate what audio data is being included in the audio signals with the other smart speakers 304. For example a particular smart speaker 304 may indicate to nearby smart speakers 304 that it has just played a sound of a bird taking flight. The indication may cause a nearby smart speaker 304 to play sounds of a bird flying. To continue the example, a series of smart speakers 304 may play sounds of a bird flying one after another and thereby give a person in the environment 301 the impression that a bird is flying over or through the environment 301.

In some embodiments one particular smart speaker 304 may operate as a master or leader. The master smart speaker 304 may then instruct other smart speakers 304 which audio data to include in their audio signals and at which time. In some embodiments the master smart speaker 304 may be the only one to communicate with the audio data source 320 and/or the controller 330.

In some embodiments the audio system 300 may also include one or more speakers 302 and one or more amplifiers 306. Two speakers are illustrated: first speaker 302A, and second speaker 302B (collectively referred to as speakers 302 and/or individually referred to as speaker 302). One amplifier is illustrated: amplifier 306A (the amplifiers 306 may be collectively referred to as amplifiers 306 and/or individually revered to as amplifier 306). However, the audio system 300 may include any number of speakers and/or amplifiers.

The smart speakers 304 may be configured to provide audio signals for one or more speakers 302, such as, for example, the speaker 302A or the speaker 302B. The smart speakers 304 may be configured to generate amplified audio signals, such as, for example audio signals that have been amplified by the amplifier 315A. Additionally or alternatively the smart speakers 304 may be configured to generate audio signals that may be subsequently amplified by amplifiers such as, for example amplifier 306A.

Because the smart speakers 304 may be capable of generating one or more audio signals for one or more speakers 302, it may be possible to implement the audio system 300 as described in this disclosure by placing smart speakers 304 into an existing audio system. For example, it may be possible to retrofit the existing audio system of an environment to implement the audio system 300 as described in this disclosure. For example, it may be possible to introduce one or more smart speakers 304 to the environment, and connect one or more speakers of the existing audio system to the smart speakers 304. The smart speakers 304 may then be configured to generate audio signals for the speakers of the existing audio system.

Modifications, additions, or omissions may be made to the audio system 300 without departing from the scope of the present disclosure. For example, the audio system 300 may include other elements than those specifically listed. Additionally, the audio system 300 may be included in any number of different systems or devices. Further, in some embodiments the audio system 300 may omit one or more of the elements described or illustrated in FIG. 3. For example, the audio system 300 may operate without any sensors 308. Additionally or alternatively the audio system 300 may come preloaded with audio data and thus not need to receive audio data from the audio data source 320.

Likewise, the smart speakers 304 may omit one or more elements described or illustrated in FIG. 3. For example, the smart speaker 304A may omit the sensor 308A. As another example one or more of the computing system 310 of the smart speakers 304 in a particular audio system 300 may omit the data storage 214 and instead receive audio data, or even an audio signal from another smart speaker 304 of the audio system 300.

Figure 4:
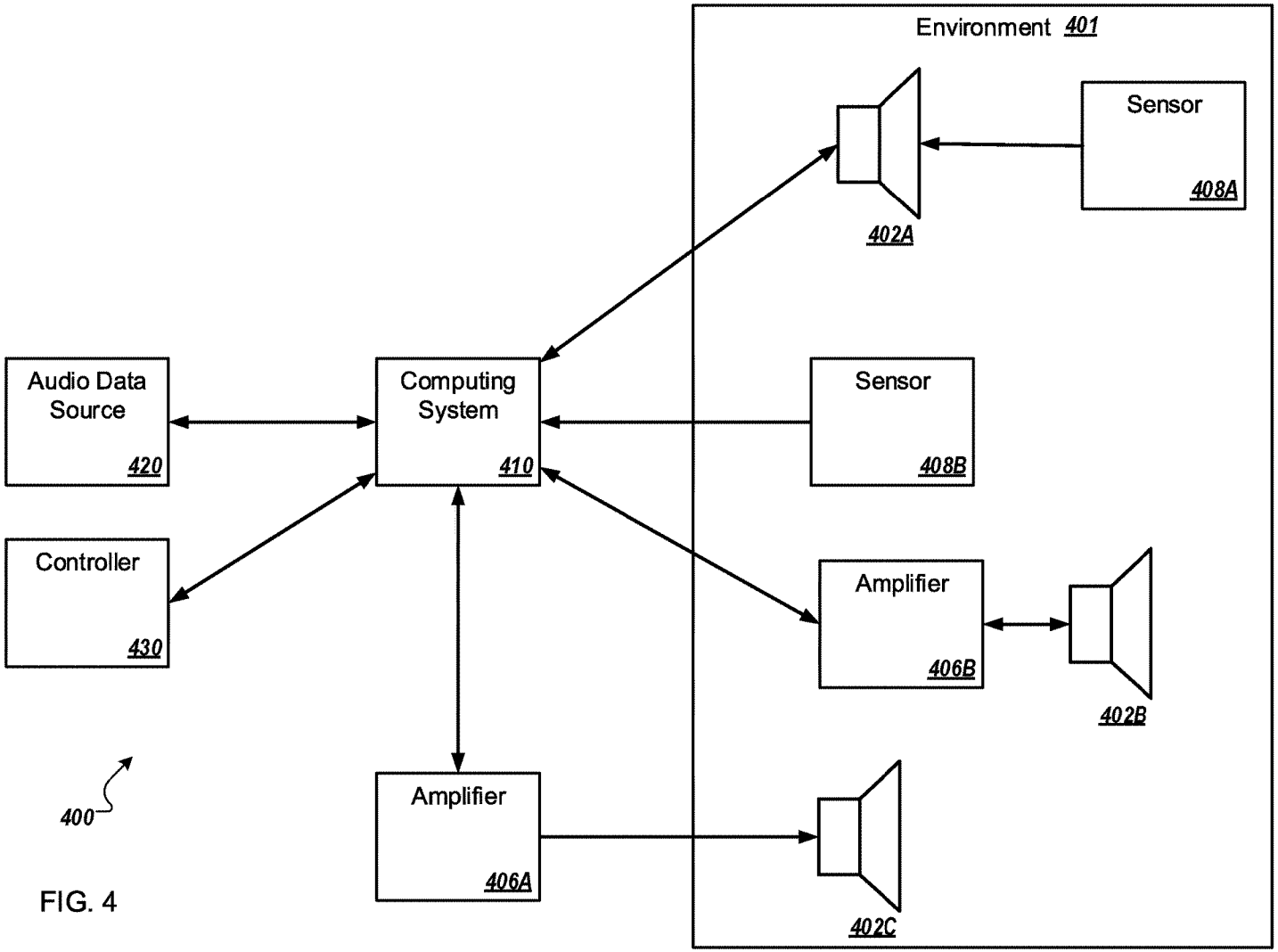
FIG. 4 is a block diagram of another example audio system configured to generate dynamic audio in an environment.

FIG. 4 is a block diagram of another example audio system 400 configured to generate dynamic audio in an environment 401 arranged in accordance with at least one embodiment described in this disclosure. FIG. 4 illustrates another embodiment of the audio system of the present disclosure, audio system 400, which is configured to generate dynamic audio in the environment 401. The audio system 400 may include a computing system 410, an audio data source 420, a controller 430, one or more speakers 402, one or more amplifiers 406, and one or more sensors 408. Three speakers are illustrated: first speaker 402A, second speaker 402B, and third speaker 402C (collectively referred to as speakers 402 and/or individually referred to as speaker 402). Two amplifiers are illustrated: first amplifier 406A, and second amplifier 406B (collectively referred to as amplifiers 406 and/or individually referred to as amplifier 406). Two sensors are illustrated: first sensor 408A, and second sensor 408B, (collectively referred to as sensors 408 and/or individually referred to as sensor 408). However, the number of speakers and sensors may vary according to different implementations.

The audio system 400 may include one or more computing systems 410. The computing systems 410 may be the same as or similar to the computing system 210 of FIG. 2. The computing system 410 may be configured to control operations of the audio system 400 such that the audio system 400 may generate dynamic audio in the environment 401. The computing system 410 may include an audio signal generator similar or analogous to the audio signal generator 100 of FIG. 1 such that the computing system 410 may be configured to implement one or more operations related to the audio signal generator 100 of FIG. 1.

In the present disclosure, reference to the audio system 400 performing operations may include operations performed by the any element, or combination of elements of the audio system 400. For example, reference to the audio system 400 performing an operation may include performance of that operation by the computing system 410 and/or the computing system 410 and one or more speakers 402. For example, generation of an audio signal by the computing system 410 may be referred to as the audio system 400 generating an audio signal. For another example, a particular speaker 402 providing audio based on an audio signal may be referred to as the audio system 400 providing audio. In addition, reference to the audio system 400 performing an operation may include operations that may be dictated or controlled by an audio signal generator such as the audio signal generator 100 of FIG. 1.

In general, the audio system 400 may generate dynamic audio in the environment 401. The computing system 410 may be configured to obtain audio data from the audio data source 420. The computing system 410 may be configured to generate audio signals from the audio data. The generation of the audio signals may include adjusting the audio data according to one or more of the characteristics of the speakers 402, the position of the speakers 402 in the environment 401, and/or attributes of the environment 401 itself. Further the generation of the audio signals may include composing more than one audio data into the audio signals. The computing system 410 may be configured to generate a unique audio signal for each of the speakers 402. The speakers 402 may be configured to play the audio signals. The audio system 400 may further include one or more sensors 408 in the environment 401. The computing system 410 may be further configured to adjust the audio signals based on a condition of the environment 401 that has been detected by the sensors 408. Additionally or alternatively, the computing system 410 may be configured to adjust the audio signals based on random numbers. The speakers 402 may be configured to play the adjusted audio signals. By adjusting audio signals and playing adjusted audio signals, the audio system 400 may be generating dynamic audio in the environment 401.

The environment 401 may be the same or similar as the environment 301 of FIG. 3. The audio data source 420 may be the same or similar as the audio data source 320 of FIG. 3. The controller 430 may be analog the same or similar as the controller 330 of FIG. 3. The sensors 408 may be the same or similar as the sensors 308 of FIG. 3. For example, the sensor 408A, and the sensor 408B may be the same or similar as the sensor 308B of FIG. 3.

In some embodiments the audio system 400 may include the speakers 402. A single speaker 402 may include a device configured to provide audio based on an audio signal. In some embodiments the speakers 402 may be positioned in the environment 401. Additionally or alternatively one or more speakers 402 may be positioned outside the environment 401. In these or other embodiments the speakers 402 may be configured to generate audio in the environment 401. In some embodiments the speakers 402 may be the same or similar as the speaker unit 316A of FIG. 3, and/or the speakers 302 of FIG. 3.

In some embodiments the audio system 400 may include the amplifiers 406. The amplifiers 406 may include devices configured to amplify the audio signals. The amplifiers 406 may be included in the audio system 400 to amplify audio signals before being played by the speakers 402. In some embodiments the amplifiers 406 may be in the environment 401. For example, the amplifier 406B may be within the environment 401. For example the amplifier 406B may be near the speaker 402B. In some embodiments the amplifiers 406 may be outside the environment 401. For example the amplifier 406A may be outside the environment, but connected to the speaker 402C which may be within the environment 401. In some embodiments the amplifiers 406 may be integrated into the speakers 402. For example, the speaker 402A may have an amplifier (not illustrated in FIG. 4) integrated into the speaker 402A. The amplifiers 406 may be the same or similar as the amplifiers 306 of FIG. 3. For example, the amplifier 406A, and the amplifier 406B may be the same or similar as the amplifier 306B of FIG. 3.

In some embodiments the speakers 402 may be communicatively connected to the computing system 410. The communicative connection may include amplification, such as, for example amplifiers 406. The communicative connection may include the ability for the computing system 410 to transmit an audio signal to the speakers 402. The communicative connection between the computing system 410 and the speakers 402 may include wires, such as, for example audio cables, or network cables. Additionally or alternatively the communicative connection between the computing system 410 and the speakers 402 may be through any suitable wireless technique, such as, for example, IR communications, wireless Ethernet such as, for example, IEEE 802.11, or Bluetooth.

In some embodiments, the computing system 410 may perform, or cause to be performed, one or more of the operations described above in relation to the operation of the audio signal generator 100 of FIG. 1 In particular, the computing system 410 may obtain audio data from the audio data source 420. The computing system 410 may receive a signal to initiate operation of the audio system 400 from the controller 430. The computing system 410 may configure, or direct configuration, of the audio system 400 for operation as described with relation to the operation of the configuration manager 110 of FIG. 1. The computing system 410 may generate, or direct generation, of audio signals as described with relation to the operation of the playback manager 130 of FIG. 1. The computing system 410 may obtain sensor output signals from the sensors 408. The computing system 410 may adjust, or direct adjustment of, the audio signals as described with relation to the playback manager 130 of FIG. 1.

Because the computing system 410 may be capable of generating one or more audio signals for one or more speakers 402, it may be possible to implement the audio system 400 as described in this disclosure by placing the computing system 410 into an existing audio system. For example, it may be possible to retrofit the existing audio system of an environment to implement the audio system 400 as described in this disclosure. For example, it may be possible to introduce the computing system 410 into the existing audio system, and connect one or more speakers of the existing audio system to the computing system 410. The computing system 410 may then be configured to generate audio signals for the speakers of the existing audio system. The computing system 410 may or may not be in or near the environment 401.

Additionally or alternatively, it may be possible to include one or more smart speakers, such as, for example, the smart speakers 304 from FIG. 3 into the audio system 400. If smart speakers are included in the audio system 400, the smart speakers may be configured to operate as speakers 402. For example, the computing system 410 may generate audio signals for one or more smart speakers in the audio system 400. Additionally or alternatively, if smart speakers are included in the audio system 400, the smart speakers may be configured to generate their own audio signals. In such a case, the smart speakers may be configured to communicate with the computing system 410. The communication between the smart speakers and the computing system 410 of the audio system 400 may be as described above with regard to communications between the smart speakers 304 of FIG. 3. For example, the smart speakers in the system may operate as peers to the computing system 410. Additionally or alternatively, the smart speakers in the system may operate as slaves to the computing system 410.

Modifications, additions, or omissions may be made to the audio system 400 without departing from the scope of the present disclosure. For example, the audio system 400 may include other elements than those specifically listed. Additionally, the audio system 400 may be included in any number of different systems or devices. Further, in some embodiments the audio system 400 may omit one or more of the elements described or illustrated in FIG. 4.

Figure 5:
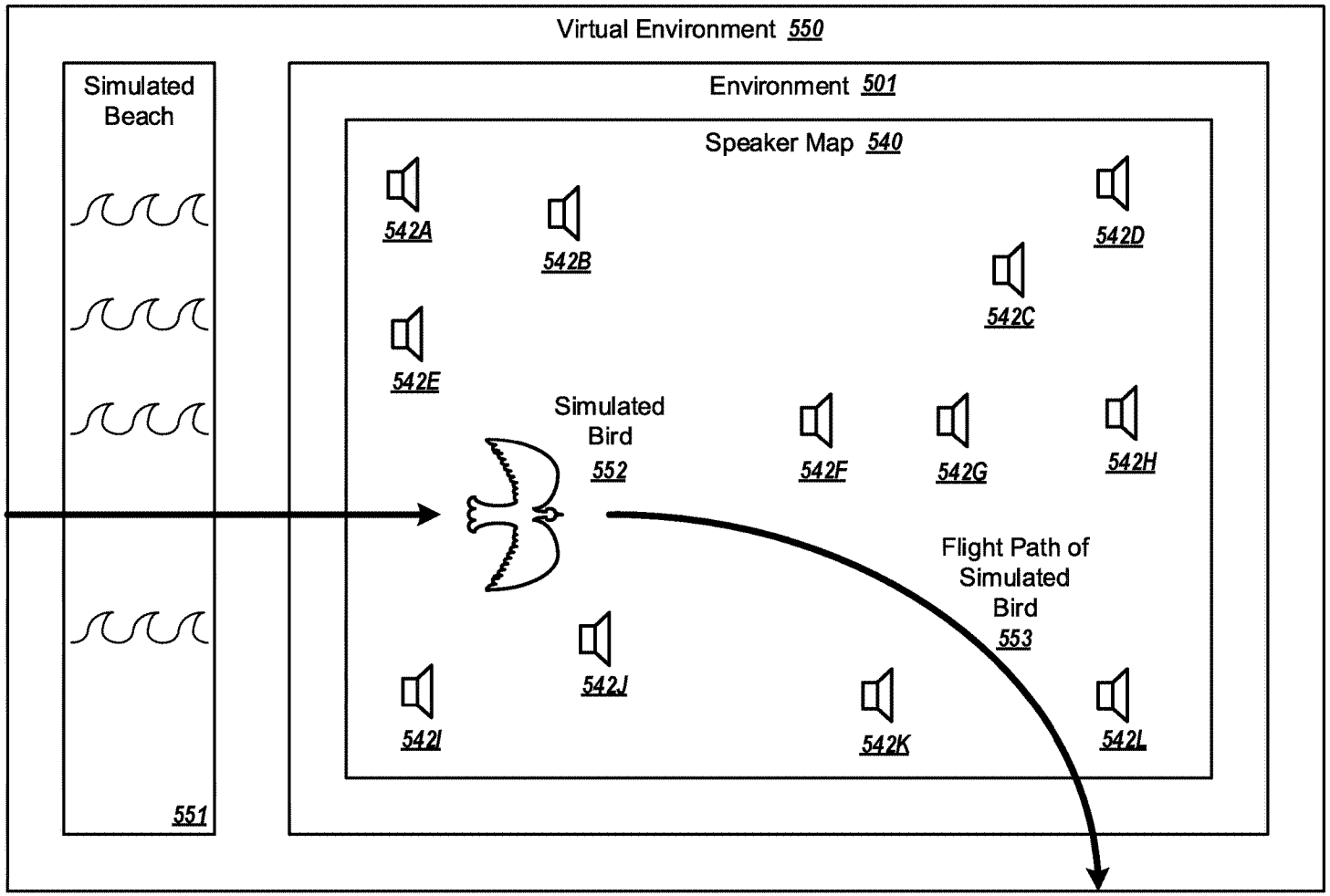
FIG. 5 illustrates an example environment in which an example audio system may operate overlaid with a virtual environment and a speaker map.

FIG. 5 is an illustration of an example environment 501 in which an example audio system may operate overlaid with a virtual environment 550 and a speaker map 540 arranged in accordance with at least one embodiment described in this disclosure. FIG. 5 illustrates concepts that may be used in implementing the audio system of this disclosure. For example, FIG. 5 illustrates one example of how the audio system might be configured to generate and/or adjust audio based on the environment and the position of the speakers in the environment. FIG. 5 illustrates one example of how the audio system might be configured to generate unique audio signals for different speakers in the audio system.

In some embodiments information about the speakers and the environment 501 may be used when configuring the audio system for operation, when generating audio in the environment 501, and when adjusting the audio being generated. A speaker map 540 is an example of a conceptual way of organizing and representing the information that may be used in the configuration of the audio system, or in the generation and/or adjustment of audio signals. The speaker map 540 may include information about the speakers of the audio system and information about the environment. In some embodiments the operational parameters may represent information about the environment and the speakers without using the speaker map 540. In some embodiments the speaker map 540 may be included in operational parameters, which may be the same as, or similar to the operational parameters 120 of FIG. 1.

The speaker map 540 may be generated through a space characterization process. The space characterization process may be handled using a controller, such as the controller 330 of FIG. 3 or the controller 430 of FIG. 4. The space characterization process may be used to determine an accurate position and/or orientation of each of the speakers in the environment 501. The space characterization process may be used to determine characteristics of a space, such as locations of the ceiling, floor, and walls.

The space characterization process may also be used to determine audio deficiencies for each speaker resulting from placement/orientation constraints or physical aspects of the space. Example deficiencies may include speaker that may be partially obscured by an object, a speaker pointing away from the "center" of the space, a speaker positioned adjacent to a wall, a speaker placed facing a well, one or more hard surfaces causing reflections within the space, limited frequency response of a poor speaker, etc. The space characterization process may also be used to determine deficiencies in the speaker layout for the space, such as whether the speakers are placed too closely together, whether the speakers are placed too far apart, whether a desired type of sound projection with a layout may not be able to deliver (e.g., all speakers are on or near the ceiling making it difficult to achieve a 3D sound field, etc. The space characterization process may be used to determine an overall characterization of the sound projection in the space, such as overhead sound, a wall of sound, surround sound, complete volume of sound, etc.

In some embodiments one or more speakers and one or more sensors may be used in the space characterization process. In the present disclosure, space characterization may be referred to as obtaining acoustic properties of the environment. In some embodiments one or more speakers may generate a signal, such as, for example a ping signal, and transmit the signal into the environment. The ping signal may include electromagnetic radiation, such as, for example light or infrared light. Additionally or alternatively the ping signal may include sound, including subsonic or ultrasonic frequencies. The ping signal may be transmitted into the environment. The ping signal may reflect off one or more physical objects in the environment, including for example, floors, wall, ceilings, and/or furniture. The ping signal may be received by one or more sensors. The transmitted ping signal may be compared with the reflected ping signal. The comparison may be used to generate acoustic properties of the environment. For example, a time of delay between the time of transmission and the time of reception may indicate a distance between the transmitter, which may be the speaker, a reflector, and the receiver which may be the sensor. For another example, the power of the reflected signal may indicate a degree to which the environment causes or allows sound to echo. For instance, if a speaker were to transmit a sound, and the sensor, which included a microphone were to receive the reflected sound at the same volume the acoustic property of the environment may indicate that the environment allowed echoes. Additionally or alternatively, if the microphone received multiple reflections of the reflected sound, the acoustic property of the environment may indicate that the environment allowed sounds to echo. In some embodiments the ping signal may be directed and/or scanned through the environment. In some embodiments the ping signal may include multiple ping signals at different times and/or at different frequencies. For example, a speaker may transmit a high-frequency ping signal to determine a high-frequency acoustic property of the environment; additionally or alternatively the speaker may transmit a low-frequency ping signal to determine a low-frequency acoustic property of the environment.

The environment 501 may be the same or similar as the environment 301 of FIG. 3 and/or the environment 401 of FIG. 4 in which an audio system the same or similar as the audio system 300 and/or the audio system 400 may operate.

The audio system of FIG. 5 (not illustrated in FIG. 5) may include a computing system (not illustrated in FIG. 5) that may be the same as or similar to the computing system 210 of FIG. 2. The computing system may be configured to control operations of the audio system such that the audio system may generate dynamic audio in the environment 501. The computing system may include an audio signal generator similar or analogous to the audio signal generator 100 of FIG. 1 such that the computing system may be configured to implement one or more operations related to the audio signal generator 100 of FIG. 1. In the present disclosure, the audio system generating one or more audio signals, and the speakers of the audio system providing audio based on the audio signals may be referred to as the audio system playing sound or the audio system playing audio data. In addition, reference to the audio system performing an operation may include operations that may be dictated or controlled by an audio signal generator such as the audio signal generator 100 of FIG. 1.

In some embodiments the speaker map 540 which may include positions of one or more speakers may be used in the configuration of the audio system and/or the generation of audio signals. For example, the speaker map 540 may include a first speaker 542A, a second speaker 542B, a third speaker 542C, a fourth speaker 542D, a fifth speaker 542E, a sixth speaker 542F, a seventh speaker 542G, an eighth speaker 542H, a ninth speaker 542I, a tenth speaker 542J, an eleventh speaker 542K, and a twelfth speaker 542L (collectively referred to as speakers 542 and/or individually as speaker 542). The speakers 542 may represent the locations of actual speakers of the audio system positioned in the environment 501. Additionally or alternatively, the speaker map 540 may include speakers 542 which may be conceptual only. However, the number of speakers may vary according to different implementations.

The speaker map 540 may include properties of the speakers 542. For example, the speaker map 540 may include the size, and/or wattage of one or more speakers in the audio system. The speaker map 540 may include smart speakers, such as, for example, the smart speakers 304 or FIG. 3. Additionally or alternatively the speaker map 540 may include speakers, such as, for example the speakers 402 of FIG. 4. Because a single audio system may include both speakers, such as, for example the speakers 402 of FIG. 4 and smart speakers, such as, for example the smart speakers 304 of FIG. 3, a single speaker map 540 may include some speakers 542 that represent speakers, and some speakers 542 that represent smart speakers.

In some embodiments the speaker map 540 may include other features of the environment 501 which may affect sound in the environment 501, for example a wall, carpet, a doorway and or a street or sidewalk near the environment 501. The speaker map 540 may include actual distances between speakers in the audio system and/or other features of the environment 501. The speaker map 540 may include a two, or three dimensional map of the environment 501 including representations of the speakers of the audio system in the environment 501.

The speakers of the speaker map 540 may represent actual speakers of the audio system in the environment 501. A unique audio signal for each speaker in the audio system may be generated. The generation of unique audio signals for each speaker in the audio system may be based on the speaker map 540. For example, the speaker system may delay the playing of audio data for speakers in the audio system based on the distances between the speakers 542 in the speaker map 540.

In some embodiments one or more smart speakers of the audio system may be configured to include information of the speaker map 540. Additionally or alternatively a particular smart speaker may only include information related to itself and its immediate surroundings. For example, a particular smart speaker may include information about the particular smart speaker, the distance and direction between the particular smart speaker and the particular smart speaker's neighboring speakers, and acoustic information about the particular smart speaker immediate surroundings. For another example, a particular smart speaker may store only operational parameters which may include time delays between the particular speaker and the particular speaker's neighbors, and acoustic playback information for the particular speaker. In these or other embodiments a computing system, such as, for example, the computing system 410 of FIG. 4 may store information related to the speaker map 540.

Including audio data in an audio signal may be referred to as causing a speaker to play the audio data. Further, because of the correspondence between speakers in the audio system, and speakers 542 in the speaker map 540, causing a speaker 542A to play audio data may be synonymous with generating an audio signal for a speaker of the audio system that corresponds to the speaker 542A in the speaker map 540.

In some embodiments one or more simulated objects may be used when generating audio in the environment 501, and when adjusting the audio being generated. As an example of a conceptual way of organizing and representing the simulated objects, some audio systems may use a virtual environment 550. The simulated objects may be simulated in the virtual environment 550 and may include a conceptual representation of an object that the audio system may use to generate or adjust audio in the environment 501.

The virtual environment 550 may be overlaid onto the environment 501, such that the virtual environment 550 includes space inside the environment 501. Additionally or alternatively the virtual environment 550 may extend beyond or be detached from the environment 501.

The virtual environment 550 may correspond to the speaker map 540 and/or the environment 501. Actual distance in the environment 501 may be reflected in the speaker map 540 and/or the virtual environment 550. A point in the environment 501 may be represented in the speaker map 540 and the virtual environment 550. Real objects in the environment 501 may be represented in one or both of the speaker map 540 and the virtual environment 550. For example a wall, or a street near the environment 501 may have representation in both of the virtual environment 550 and the speaker map 540.

The simulated objects may include simulations of objects in the virtual environment 550. The simulated objects may have sound properties, location properties, and a behavior profile. The sound properties may represent indicators that may relate to certain audio data, or categories of audio data. Additionally or alternatively the sound properties may represent the manner in which the simulated object may affect sounds, for example, a wall that reflects sound. The location properties of the simulated object may include a single point, or multiple points in the virtual environment 550. Additionally or alternatively the location properties of the simulated object may extend through virtual space in the virtual environment 550. The location properties of the simulated object may be constant, or the location properties of the simulated object may change over time. The behavior profile of the simulated object may govern the manner in which the simulated object behaves over time. The behavior of the simulated object may be constant, or the behavior of the simulated object may change over time, based on a random number, or in response to a condition of the environment 501.

For example a particular simulated object may represent a beach, for example, simulated beach 551. The simulated beach 551 may have a single location; or the simulated beach 551 may extend through the virtual environment 550. Additionally or alternatively the simulated beach 551 may have distinct locations with distinct sound properties. The simulated beach 551 may have sound properties, for example, the simulated beach 551 may be related to all audio data tagged or labeled "North Shore Beach of Oahu sounds." Additionally or alternatively a first point of the simulated beach 551 may be related with certain audio data, which may have been recorded at certain portions of the North Shore Beach of Oahu, and a second point in the simulated beach 551 may be related with certain other audio data which may have been recorded at certain other portions of the North Shore Beach of Oahu. The simulated beach 551 may have a behavior profile which may include, for example, the simulated beach 551 may not move, the simulated beach 551 may change in volume over time, for example, according to the condition "time" which may be related to the tide. The simulated beach 551 may have a behavior profile that selects certain audio data to represent rising tide and other audio data to represent falling tide. The changing behavior of the simulated objects in the virtual environment 550 may cause the audio signals generated to change over time, which may result in the audio system generating dynamic audio.

In some embodiments the relationship between the virtual environment 550 and the speaker map 540 may be used to generate unique audio signals for one or more of the speakers of the audio system. Audio signals may be generated representing the simulated objects in the virtual environment 550 at the speakers nearest to the simulated objects in the speaker map 540. For example, referring again to the simulated beach 551, audio signals may be generated including the audio data of the simulated beach 551 for the speakers of the audio system that correspond to the speaker 542A, the speaker 542E, and the speaker 542I. Additionally or alternatively, the speakers of the audio system that correspond to the speaker 542A, the speaker 542E, and the speaker 542I may be caused to play audio data of the simulated beach 551 at the highest volume. The speakers of the audio system that correspond to the speaker 542D, the speaker 542H, and the speaker 542L in the speaker map 540 may not be caused to play audio data of the simulated beach 551 at all. And, the speakers of the audio system that correspond to the speaker 542B, the speaker 542C, the speaker 542F, the speaker 542G, the speaker 542J, and the speaker 542K, in the speaker map 540 may be caused to play audio data of the simulated beach 551 at an intermediate volume. This may give a person in the environment 501 the impression that the North Shore Beach of Oahu is in the direction of the speakers of the audio system that correspond to the speaker 542A, the speaker 542E, and the speaker 542I.

For another example of a simulated object, a particular simulated object may represent a simulated bird 552, which may represent, for example, a European swallow. The simulated bird 552 may have a single point location in the virtual environment 550. Also, the behavior profile of the simulated bird 552 may indicate that the location of the simulated bird 552 changes over time. Thus, the flight path of simulated bird 553 may represent a path through the virtual environment 550 to be taken by the simulated bird 552 and the rate at which the simulated bird 552 may cross the flight path of simulated bird 553. Additionally or alternatively the flight path of simulated bird 553 may represent the location of the simulated bird 552 as a function of time.

Because simulated objects may move through the virtual environment 550, which corresponds to the speaker map 540, audio data relating to simulated objects may be played at different speakers over time. For example, referring to the simulated bird 552, and the flight path of simulated bird 553, audio data of the simulated bird 552 in flight may be played at different speakers as the simulated bird 552 crosses the virtual environment 550. More than one speaker may play the audio data at the same time. Two speakers playing the audio data may play the audio data at different volumes. For example an audio data may be played at a first speaker at a volume, which may increase over time, then the audio data may be played at the first speaker at a volume that decreases over time. And, while the audio data is being played at a decreasing volume at the first speaker, the same audio data may be played at a second speaker at a volume that increases over time. This may give the impression that the simulated object is moving through the environment 501.

For example, referring to FIG. 5, the speakers of the audio system corresponding to the speaker 542E, the speaker 542F, the speaker 542G, the speaker 542I, the speaker 542J, the speaker 542K and the speaker 542L may be configured to play audio data of the simulated bird 552 in flight. Specifically, the speakers of the audio system corresponding to the speaker 542E and the speaker 542I may be configured to play the audio data of the simulated bird 552 in flight first. Based on knowing that the airspeed velocity of an unladen European swallow may be 11 meters per second, the speakers of the audio system corresponding to the speaker 542E and the speaker 542I may be configured to play the audio data of the simulated bird 552 for only a short time. The short time may be calculated from the airspeed velocity of the simulated bird 552 and the distance between speakers in the speaker map 540. Then the speaker of the audio system corresponding to the speaker 542J may be configured to play the audio data of the simulated bird 552 in flight. Then the speaker of the audio system corresponding to the speaker 542F may be configured to play the audio data of the simulated bird 552 in flight. Then the speakers of the audio system corresponding to the speaker 542G and the speaker 542K may be configured to play the audio data of the simulated bird 552 in flight. Last, the speakers of the audio system corresponding to the speaker 542K and the speaker 542L may be configured to play the audio data of the simulated bird 552 in flight. This may give a person in the environment 501 the impression that a European swallow has flown through or over the environment 501 at 11 meters per second. The changing of the audio signals being played by the speakers as the simulated bird 552 traverses the virtual environment 550 may be an example of dynamic audio.

In some embodiments the simulated behavior of a simulated object may be influenced by random numbers. For example, a simulated object may have a behavior profile that indicates the probability that the simulated object may perform a certain simulated behavior. The simulated behavior may include changing the location of the simulated object in the virtual environment 550, such as, for example, the flight path of simulated bird 553. Additionally or alternatively the simulated behavior may include a frequency at which the simulated behavior may be simulated. For example, the behavior profile of the simulated bird 552 may indicate that the simulated bird 552 is to traverse the virtual environment 550 at regular, random, or pseudo random intervals. Additionally or alternatively, the flight path of simulated bird 553 may be changed over time, or with each flight of the simulated bird 552. These changes may be based on random numbers. For example, the curvature of the flight path of simulated bird 553 may be a result of a random number.

Additionally or alternatively the behavior profile of the simulated bird 552 may allow for multiple instances of the simulated bird 552 to traverse or be in the virtual environment 550 at any given time. The changing of the audio signals being played by the speakers as the simulated bird 552 traverses the virtual environment in changing ways or at random or pseudo-random intervals may be an example generating the audio signals based on random numbers, which may be an example of dynamic audio.

In some embodiments, the behavior profile of the simulated bird 552 may indicate that the simulated bird 552 may stop in the environment for a time. The simulated bird 552 may have sound properties including audio data related to flight and audio data related to stationary behaviors, such as, for example chirping, tweeting, or singing a birdsong. So, a behavior profile may indicate that the audio system compose audio data related to the simulated bird 552 in flight into an audio signal to be played at some speakers. Then, later, the behavior profile may indicate that the audio system compose audio data related to the simulated bird 552 at rest into an audio signal to be provided to some speakers. Then later the behavior profile may indicate that the audio system compose audio data related to the simulated bird 552 in flight into an audio signal to be played at some speakers. The changing audio signals being played by the speakers over time as a result of the behavior profile of a simulated object may be an example of dynamic audio.

In some embodiments simulated objects, sound properties, location properties, behavior profiles, virtual environments, scenes and/or operating instructions may be obtained for example, from an audio data source, such as, for example the audio data source 320 or FIG. 3 or the audio data source 420 of FIG. 4. The audio data source may store ready-to-use virtual environments that may be implemented by the audio system. Additionally or alternatively, the audio data source may store ready-to-use simulated objects that may be placed in the virtual environment 550 of the audio system by a user. Additionally or alternatively, the audio data source may store sound properties, location properties, and/or behavior profiles of simulated objects that can be added to simulated objects in the virtual environment 550 of the audio system by the user. For example, the audio data source may store a complete virtual beach ready to be downloaded and implemented at an audio system. For another example, the audio data source may store a virtual seagull ready to be downloaded and added to a virtual environment 550 at an audio system. For another example, the audio data source may store a behavior profile for a generic songbird, and sound properties for a wood thrush, these may be downloaded and added to a simulated object in the virtual environment 550 at an audio system.

In some embodiments the audio data source may store scenes, which may include collections of simulated objects, sound properties, location properties, behavior profiles, and/or virtual environments that may relate to a common theme. The audio system may obtain entire scenes at once, and then allow the user to implement the virtual environment as the user sees fit. For example, the audio data source may include a Christmas scene which may include simulated objects including Christmas songs, a sleigh with sleigh bells, elves, a roaring fire, Santa laughing, and/or carolers. The Christmas scene may also include preconfigured virtual environments including simulated objects ready to be implemented.

The virtual environment 550 may be implemented, configured, and/or initiated by the user using a controller, such as, for example the controller 330 of FIG. 3. For example, the controller may give the user an interface allowing the user to place a simulated object in the virtual environment 550. The interface may further allow the user to configure the sound properties, and/or the behavior profile of that simulated object.

Modifications, additions, or omissions may be made without departing from the scope of the present disclosure. For example, the speaker map 540 and/or the virtual environment 550 may include other elements than those specifically listed. Further, in some embodiments the speaker map 540 and/or the virtual environment 550 may omit one or more of the elements described or illustrated in FIG. 5.

Figure 6:
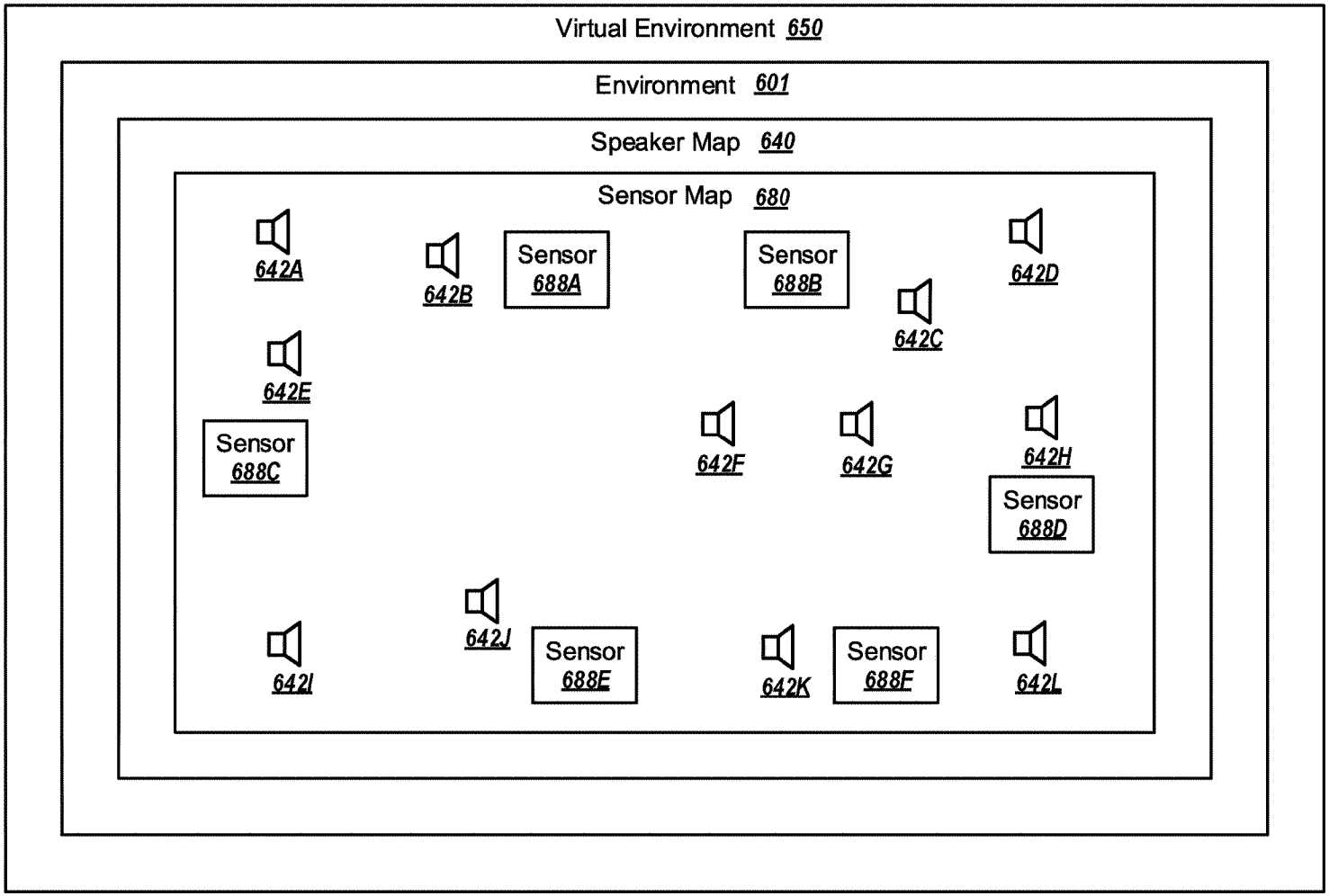
FIG. 6 illustrates an another example environment in which an example audio system may operate, overlaid with a virtual environment, a speaker map, and a sensor map.

FIG. 6 illustrates an example environment 601 in which an example audio system may operate, overlaid with a virtual environment 650, a speaker map 640, and a sensor map 680 arranged in accordance with at least one embodiment described in this disclosure. FIG. 6 illustrates concepts that may be used in implementing the audio system of this disclosure. For example, FIG. 6 illustrates one example of how the audio system might be configured to generate and/or adjust audio based on a condition of the environment. FIG. 6 illustrates one example of how the audio system might be configured to generate unique audio signals for different speakers in the audio system based on the condition of the environment.

In some embodiments the condition of the environment 601 may be used in the generation of audio for the environment 601, and when adjusting the audio being generated. As an example of a conceptual way of organizing and representing the information related to the condition of the environment 601, some audio systems may use a sensor map 680. The sensor map 680 may include a representation of the locations of sensors of the audio system. The sensor map 680 may further include the category of condition which the sensors of the sensor map 680 are configured to detect. The sensor map 680 may additionally include a range, or sensitivity related to the sensors of the sensor map 680. In some embodiments the audio system may represent information about the sensors without using the sensor map 680. In some embodiments the sensor map 680 may be included in operational parameters, which may be the same as, or similar to the operational parameters 120 of FIG. 1.

In some embodiments one or more smart speakers of the audio system may be configured to include information of the sensor map 680. Additionally or alternatively a particular smart speaker may only include information related to a nearby, or attached sensor. In these or other embodiments a computing system, such as, for example, the computing system 410 of FIG. 4 may store information related to the sensor map.

The environment 601 may be the same or similar as the environment 301 of FIG. 3, the environment 401 of FIG. 4, and/or the environment 501 in which an audio system the same or similar as the audio system 300 and/or the audio system 400 may operate. The virtual environment 650 may be the same or similar as the virtual environment 550 of FIG. 5. The speaker map 640 may be the same or similar as the speaker map 540 of FIG. 3.

The audio system of FIG. 6 (not illustrated in FIG. 6) may include a computing system (not illustrated in FIG. 6) that may be the same as or similar to the computing system 210 of FIG. 2. The computing system may be configured to control operations of the audio system such that the audio system may generate dynamic audio in the environment 601. The computing system may include an audio signal generator similar or analogous to the audio signal generator 100 of FIG. 1 such that the computing system may be configured to implement one or more operations related to the audio signal generator 100 of FIG. 1. In the present disclosure, the audio system generating one or more audio signals, and the speakers of the audio system providing audio based on the audio signals may be referred to as the audio system playing sound or the audio system playing audio data. In addition, reference to the audio system performing an operation may include operations that may be dictated or controlled by an audio signal generator such as the audio signal generator 100 of FIG. 1.

The speaker map 640 may include one or more speakers 642. For example, the speaker map 640 may include a first speaker 642A, a second speaker 642B, a third speaker 642C, a fourth speaker 642D, a fifth speaker 642E, a sixth speaker 642F, a seventh speaker 642G, an eighth speaker 642H, a ninth speaker 642I, a tenth speaker 642J, an eleventh speaker 642K, and a twelfth speaker 642L (collectively referred to as speakers 642 and/or individually as speaker 642). However, the number of speakers may vary according to different implementations.

The sensor map 680 may include one or more sensors 688. For example, the sensor map 680 may include a first sensor 688A, a second sensor 688B, a third sensor 688C, a fourth sensor 688D, a fifth sensor 688E, and a sixth sensor 688F (collectively referred to as sensors 688 and/or individually as sensor 688). However, the number of sensors may vary according to different implementations.

The virtual environment 650 may correspond to the speaker map 640, the sensor map 680 and/or the environment 601. Actual distance in the environment 601 may be reflected in the speaker map 640, the sensor map 680, and/or the virtual environment 650. A point in the environment 601 may be represented in the speaker map 640, the sensor map 680, and/or the virtual environment 650. In some embodiments the sensor map 680 may be part of the speaker map 640. In these or other embodiments the sensors 688 may be included in the speaker map 640.

The virtual environment 650 may include simulated objects that may be the same or similar as the simulated objects described above with relation to FIG. 5. The simulated objects may have sound properties, location properties, and/or behavior profiles.

The behavior profiles of the simulated objects may include responses to conditions, the conditions may be the same or similar as the conditions described above with relation to FIG. 3. The conditions may include conditions of the environment 601 that may be detected or indicated by readings of sensors, for example, sensors 308 of FIG. 3. The audio system generating an audio signal based on a simulated object responding to a condition may be an example of the audio system generating an audio signal based on the condition of the environment. Also, the audio system providing audio at speakers in response to a condition because of behavior profiles of simulated objects may be an example of dynamic audio.

For example, a virtual environment 650 may include a simulated object that may be a tiger hiding in tall grass. If sensors indicate that the condition of the environment 601 may be "vacant," the behavior profile of the simulated object may be dictate that the simulated object remain silent. If the condition of the room changes, for example, to "occupied," the behavior profile of the simulated object may dictate that the audio system begin playing audio data related to the simulated object at speakers related to the location of the simulated object. For example, the virtual tiger may have a location in the virtual environment 650 that may correspond to a location in the speaker map 640 near speaker 642F. Thus, the audio system may be configured to play audio data of a "tiger walking through tall grass" at the speaker in the audio system corresponding to the speaker 642F, then the speaker 642E. The audio system generating the audio signals for the speakers in response to the detected condition, for example the occupancy condition, may be an example of the audio system generating audio signals based on the condition of the environment. Also, the audio system providing audio at speakers in response to a detected condition, for example, the occupancy condition of the environment 601, may be an example of the audio system generating dynamic audio. In at least some embodiments, the audio system may sample the room, such as by using one or more sensors 688 to detect a geometry of the room. Based on the geometry of the room, or a detected change in geometry of the room, the audio system may alter the audio data, such as by making corrections to the audio data to provide an improved audio experience.

Further, sensors of the audio system may be configured to take readings specific to the sensors. These specific readings may include local readings, which may indicate local conditions, such as, for example, the presence of a person near a particular sensor 688. In some embodiments, simulated objects may have behavior profiles that include responses to local conditions. The responses to local conditions may be localized at speakers near the local condition. Additionally or alternatively the responses to local conditions may occur throughout the environment, or at locations distant from the local conditions. Audio signals for the speakers may be generated based on local conditions detected by one or more sensors 688.

For example, an audio system may be configured to play music in an environment 601. The purpose of the music may be to create ambiance in the environment 601 without being too loud for conversations. In the environment 601, the music may be a simulated object. The music may be played initially at an equal volume at all speakers of the environment 601. However, if a sensor in the environment, for example, a sensor corresponding to sensor 688D indicates a high noise level locally, the volume of the music may decrease at speakers corresponding to the speaker 642H. Alternatively, if a sensor in the environment, for example, a sensor corresponding to sensor 688F indicates a high noise level locally, the volume of the music may increase at speakers corresponding to the speaker 642A, the speaker 642B, the speaker 642C, the speaker 642D, the speaker 642E, the speaker 642F, the speaker 642G, the speaker 642H, the speaker 642I, and the speaker 642L.

The audio system generating the audio signals in response to the noise level detected by a single sensor may be an example of the audio system generating the audio signals based on the condition of a location within the environment. The audio system generating different audio signals for different speakers may be an example of the audio system generating unique audio signals for each of the speakers of the audio system. The audio system providing audio at certain speakers of the audio system in response to readings of sensors 688 in the environment 601 may be an example of dynamic audio.

For another example, an audio system may be configured to play audio data related to a librarian in an environment 601. The purpose of the simulated librarian may be to encourage silence in the environment 601. In the environment 601, the virtual librarian may be a simulated object. The librarian may be configured to remain silent initially. However, if a sensor in the environment, for example, a sensor corresponding to sensor 688F indicates a high noise level locally, audio data that sounds like the ghost librarian from the movie Ghostbusters® saying "shhh!" may be played at speakers corresponding to the speaker 642K. Additionally or alternatively, if the sensor in the environment, for example, a sensor corresponding to sensor 688F continues to indicate a high noise level locally after a time, audio data that sounds like a librarian saying "silence please" may be played at speakers corresponding to the speaker 642K. Additionally or alternatively audio data may be played at a different speaker. For example, audio data may be played that sounds like a voice saying "loud patrons in the children's section" at the speaker that corresponds to the speaker 642A which may, for example, be positioned at a service desk.

For another example, an audio system may be configured to include a simulated bird in the virtual environment 650. The virtual bird may be configured to produce birdsong. Further, the simulated bird may have a location in the virtual environment 650, for example, near the speaker corresponding to the speaker 642C. Thus, the speaker 642C may be directed to play audio data of the birdsong. However, if a sensor in the environment that is near the location of the simulated bird, for example, a sensor corresponding to sensor 688B indicates a person locally, audio data that sounds like a the virtual bird taking flight may be played at speakers corresponding to the speaker 642C. Subsequently, audio data of the simulated bird singing may be played at a different location which may be near a sensor that is not indicating the presence of a person, for example the speaker corresponding to the speaker 642E which may be near the sensor corresponding to the sensor 688C, which may be indicating a condition of "vacancy."

For another example, an audio system may be configured to generate different audio based on the time or season. For example, the audio system may be configured with a virtual environment 650 that includes seasonal simulated objects. For example the virtual environment 650 may include seasonal simulated birds that may enter the virtual environment 650 only if a time or date sensor indicates that the current date is within the right season for the simulated seasonal birds. Additionally or alternatively the audio system may include simulated objects that may enter in the virtual environment 650 based on the time of day. For example, the virtual environment 650 may include simulated birds during the day hours, and simulated bats during the night hours.

For another example the audio system may be configured to generate different audio based on data not related to the environment 601, such as, for example, data from a service. In some embodiments the audio system may be configured to generate different audio based on third-party data that may be from a data provider. Third-party data may be referred to as "data from a service." A data provider may be referred to as a "service." The data from the service may include, for example, weather data, calendar data, tide data, moon data, current events data, local events data, and news data, etc. For example the audio system may be configured not to include simulated birds in the virtual environment 650 if it is raining outside. The service may inform the audio system whether it is raining outside and the audio system may adjust the audio signal accordingly. In another example, the audio system may be configured to include simulated wolves in the virtual environment 650 that may be configured to howl, on clear nights when the moon is visible. For example, a behavior profile of the simulated wolves may indicate that the simulated wolves howl based on a calendar indicating an appropriate phase of the moon, and weather sensors indicating a clear night. Additionally or alternatively, the audio system may include local intelligence such that the audio system may detect local information in the space and may make decisions based on the detected location information. In this example, the audio system may not be constantly connected to the Internet or to the service. In some embodiments where a local master or leader speaker is implemented, the master or leader speaker could make the decisions based on the detected local information.

In some embodiments the audio system may adjust and/or generate different audio based on the third-party data from the data provider based on one or more rules that govern the adjustment and/or generation of audio. In some embodiments the rules may be conditioned on the type of third-party data. For example, if the third-party data includes weather data, the rules may indicate different behavior than if the third-party data includes local events data. In some embodiments the rules may be conditioned on the third-party data itself. For example, if third-party weather data indicates high temperatures the rules may indicate a different behavior than if the third-party data indicates low temperatures. In some embodiments the rules governing the handling of third-party data may be included in the behavior profiles of one or more simulated objects. In some embodiments the rules governing the handling of third-party data may be included in one or more scripts.

In some embodiments the audio system may be configured to analyze conditions of the environment 601 or indications from the sensors 688. In some embodiments the audio system may be configured to characterize one or more conditions of the environment. For example, the audio system may be configured to analyze one or more frequency characteristics of sound readings taken by the sensors. The audio system may be configured to characterize the sounds based on the analysis. In some embodiments the audio system may be configured to respond differently to different conditions based on the analysis and/or the characterization. In some embodiments there may be rules that govern the adjustment or audio based on the characterization of conditions of the environment. For example, the audio system may be configured to differentiate between the sound of conversation, the sound of music, and the sound of dishes clattering; then the audio system may be configured to respond differently to the sounds of conversation than to the sound of dishes being dropped. For example, the audio system may be configured to increase or decrease the volume of music in the environment 601 based on the sound level of conversations detected by the sensors; but, the audio system may be configured to not increase or decrease the volume of music in the environment 601 based on the sound of a dishes being dropped. For another example, the audio system may be configured to decrease the volume of music being played by the audio system, or cease playing the music, based on the sensors detecting live music being performed in the environment 601 or an active fire alarm. In some embodiments the rules governing the behavior of the audio system in response to the characterization of the condition of the environment may be handled by one or more behavior profiles of one or more simulated objects. In these or other embodiments the rules governing the behavior of the audio system in response to the characterization of the condition of the environment may be handled by one or more scripts.

Modifications, additions, or omissions may be made without departing from the scope of the present disclosure. For example, the speaker map 640, the sensor map 680 and/or the virtual environment 650 may include other elements than those specifically listed. Further, in some embodiments the speaker map 640, the sensor map 680 and/or the virtual environment 650 may omit one or more of the elements described or illustrated in FIG. 6.

Figure 7:
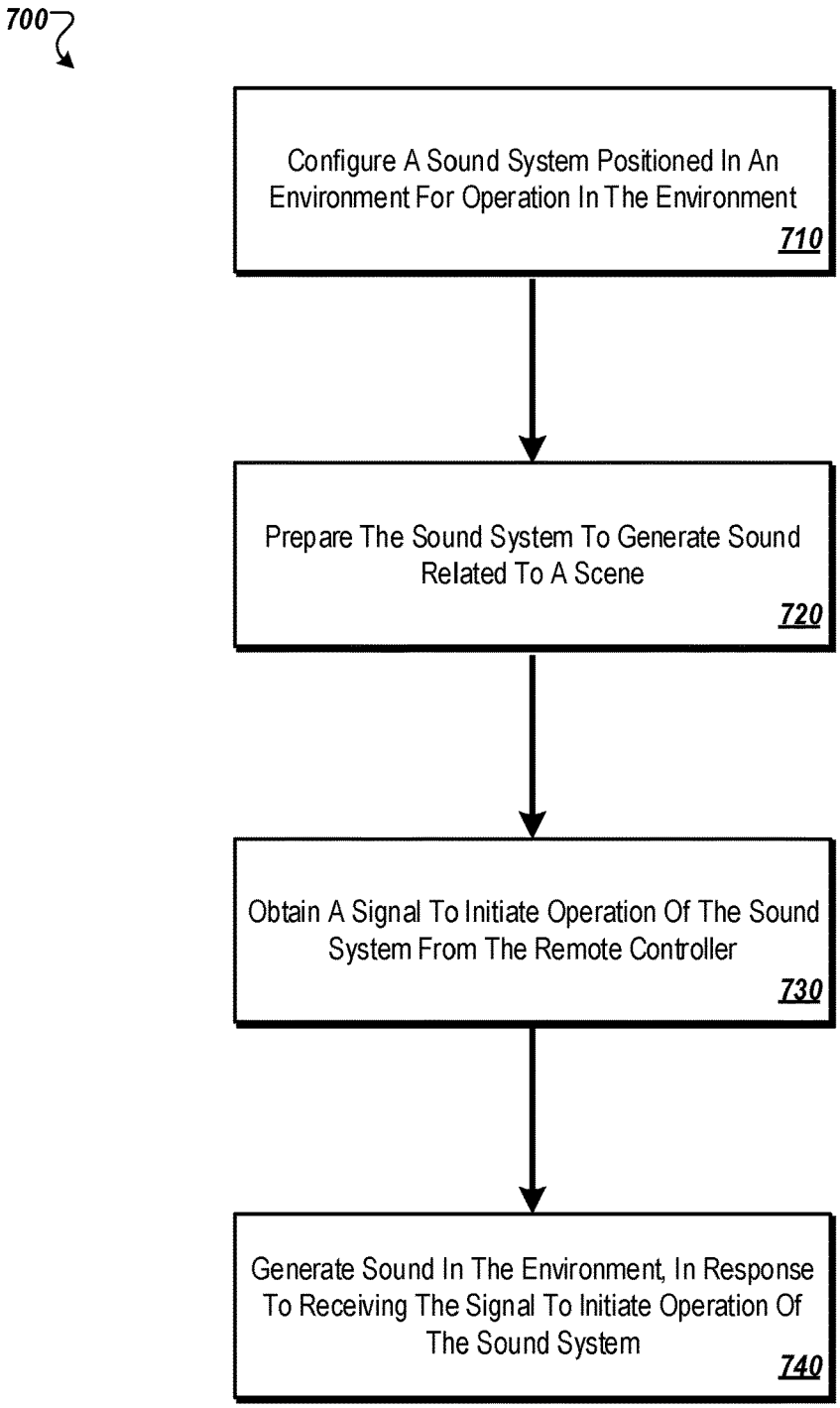
FIG. 7 illustrates an example flow diagram of an example method that may be used by an example audio system to generate dynamic audio.

FIG. 7 illustrates an example flow diagram of an example method 700 that may be used to generate dynamic audio arranged in accordance with at least one embodiment described in this disclosure. In some embodiments one or more operations associated with the method 700 may be performed by the audio signal generator 100 of FIG. 1. In some embodiments, the method 700 may be implemented at an audio system such as, for example, the audio system 300 of FIG. 3, and/or the audio system 400 of FIG. 4. Although illustrated with discrete blocks, the steps and operations associated with one or more of the blocks of the method 700 may be divided into additional blocks, combined into fewer blocks, or eliminated, depending on the desired implementation. In general, operations associated with the method 700 may cause an audio system to be configured for operation in an environment, and then audio may be generated in the environment.

The method 700 may include the block 710. At the block 710 the audio system may be configured for operation in the environment in which the audio system is positioned. One or more operations associated with block 710 may be discussed in more detail with relation to the method 800 of FIG. 8.

The method 700 may include the block 720. At the block 720 the audio system may be prepared to generate audio related to a scene. One or more operations associated with block 710 may be discussed in more detail with relation to the method 900 of FIG. 9.

The method 700 may include the block 730. At the block 730 a signal to initiate operation of the audio system may be received. The signal to initiate operation of the audio system may be sent by a controller, such as, for example, the controller 330 of FIG. 3 or the controller 430 of FIG. 4. The signal to initiate operation of the audio system may be received by the audio system. The signal to initiate operation may include further instructions and/or operational parameters.

The method 700 may include the block 740. At the block 740 audio may be generated in the environment in response to the receipt of the signal to initiate operation of the audio system. One or more operations associated with block 740 may be discussed in more detail with relation to the method 1000 of FIG. 10.

Modifications, additions, or omissions may be made to method 700 without departing from the scope of the present disclosure. For example, the functions and/or operations described may be implemented in differing order than presented or one or more operations may be performed at substantially the same time. Additionally, one or more operations may be performed with respect to each of multiple virtual computing environments at the same time. Furthermore, the outlined functions and operations are only provided as examples, and some of the functions and operations may be optional, combined into fewer functions and operations, or expanded into additional functions and operations without detracting from the essence of the disclosed embodiments.

Figure 8:
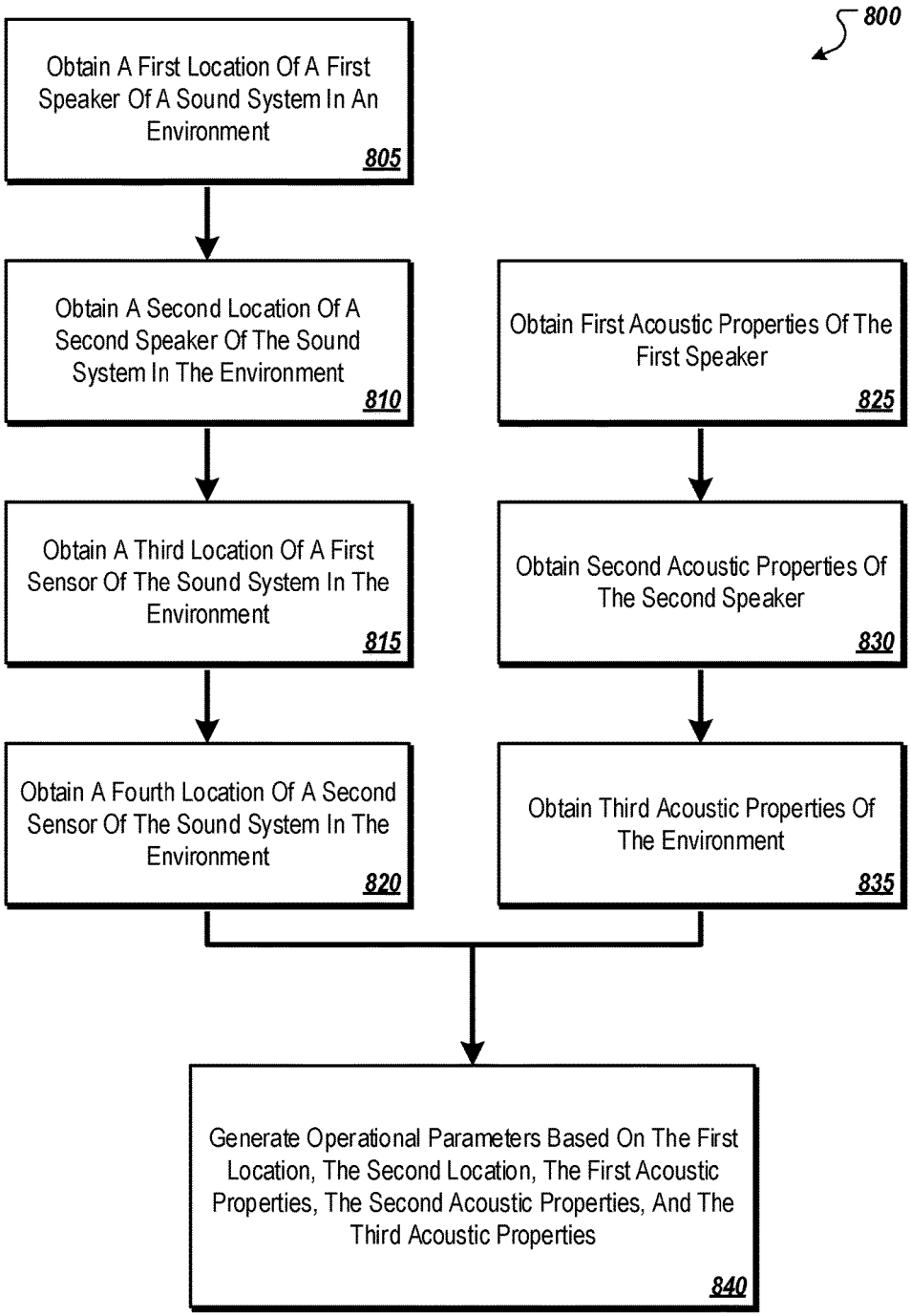
FIG. 8 illustrates an example flow diagram of example method that may be used by an example audio system positioned in an environment to configure the example audio system for operation in the environment.

FIG. 8 illustrates an example flow diagram of an example method 800 that may be used to generate dynamic audio arranged in accordance with at least one embodiment described in this disclosure. In some embodiments one or more operations associated with the method 800 may be performed by the audio signal generator 100 of FIG. 1. In some embodiments, the method 800 may be implemented at an audio system such as, for example, the audio system 300 of FIG. 3, and/or the audio system 400 of FIG. 4. Although illustrated with discrete blocks, the steps and operations associated with one or more of the blocks of the method 800 may be divided into additional blocks, combined into fewer blocks, or eliminated, depending on the desired implementation. In general, operations associated with the method 800 may cause the audio system to be configured for operation in the environment.

The method 800 may include the block 805. At the block 805 a first location of a first speaker in the audio system may be obtained. The first location may be obtained by the audio system (e.g., via an audio signal generator). The first location may be sent through a controller, such as, for example, the controller 330 of FIG. 3 or the controller 430 of FIG. 4. Additionally or alternatively the first location may be sent by a smart speaker, such as, for example, the smart speakers 304 of FIG. 3. In some embodiments the first speaker may obtain the location of the first speaker by determining the location of the first smart speaker. Additionally or alternatively the first speaker may obtain the location of the first speaker from another source.

The first location may be a location in relation to other locations of features of the environment, such as, for example, other speakers, sensors, ceiling, floor, and/or walls. Additionally or alternatively the first location may be in relation to the earth, such as, for example a latitude and longitude. The first location may be stored and/or related to other locations of features of the environment through a conceptual map, such as, for example, the speaker map 540 of FIG. 5, the speaker map 640 of FIG. 6, and/or the sensor map 680 of FIG. 6.

The method 800 may include the block 810. At the block 810 a second location of a second speaker in the audio system may be obtained. In at least some embodiments, the first location of the first speaker and the second location of the second speaker may be obtained at or near the same time. The operations associated with block 810 and the second location may be the same or similar as the operations associated with block 805 and the first location.

The method 800 may include the block 815. At the block 815 a third location of a first sensor in the audio system may be obtained. The operations associated with block 815 and the third location may be the same or similar as the operations associated with block 805 and the first location.

The method 800 may include the block 820. At the block 820 a fourth location of a second sensor in the audio system may be obtained. The operations associated with block 820 and the fourth location may be the same or similar as the operations associated with block 805 and the first location.

The method 800 may include the block 825. At the block 825 first acoustic properties of the first speaker may be obtained. The first acoustic properties may be obtained by the audio system. The first acoustic properties may be sent through a controller, such as, for example, the controller 330 of FIG. 3 or the controller 430 of FIG. 4. Additionally or alternatively the first acoustic properties may be sent by a smart speaker, such as, for example, the smart speakers 304 of FIG. 3. In some embodiments the first speaker may have information regarding the acoustic properties of the first speaker.

The first acoustic properties may include information about the first speaker, such as, for example, a size and/or wattage of the first speaker, a frequency response of the first speaker. The first acoustic properties may be stored in a conceptual map, such as, for example, the speaker map 540 of FIG. 5, the speaker map 640 of FIG. 6.

The method 800 may include the block 830. At the block 830 second acoustic properties of the second speaker may be obtained. The operations associated with block 830 and the second acoustic properties may be the same or similar as the operations associated with block 825 and the first acoustic properties.

The method 800 may include the block 835. At the block 835 third acoustic properties of the environment may be obtained. The third acoustic properties may be obtained by the audio system. The third acoustic properties may be sent through a controller, such as, for example, the controller 330 of FIG. 3 or the controller 430 of FIG. 4. Additionally or alternatively the third acoustic properties may be sent by a smart speaker, such as, for example, the smart speakers 304 of FIG. 3. In some embodiments one or more of the speakers and/or one or more of the sensors may determine the third acoustic properties.

The third acoustic properties may include information about sound or the way sound may propagate in the environment. The third acoustic properties may include information about sources of sound from outside environment, such as, for example, a part of the environment that is open to the outside, or a street or a sidewalk. The third acoustic properties may include information about sources of sound within the environment, such as, for example, a fountain, a fan, or a kitchen that frequently includes sounds of cooking. Additionally or alternatively the third properties may include information about the way sound propagates in the environment, such as, for example, information about areas of the environment including walls, tiles, carpet, marble, and/or high ceilings. The third acoustic properties may include a map of the environment with different properties relating to different sections of the map. The third acoustic properties may be stored in a conceptual map, such as, for example, the speaker map 540 of FIG. 5 of the speaker map 640 of FIG. 6.

The method 800 may include the block 840. At the block 840 operational parameters may be generated. The operational parameters may be based on the first location, the second location, the first acoustic properties, the second acoustic properties and the third acoustic properties. The operational parameters may include information that may adjust the way in which audio signals are generated for the speakers of the audio system. For example, one or more of a volume level, a frequency content, dynamics, a playback speed, or a playback duration of audio data to be included in an audio signal may be adjusted based on the operational parameters.

There may be unique operational parameters for one or more speakers of the audio system. In some embodiments there may be unique operational parameters for each speaker of the audio system.

Because the operational parameters may be based on the first location and the second location, the operational parameters may cause audio to be generated that has been configured specifically for the positions of the speakers in the environment. Because the audio system may be configured based on the position of the speakers, the speakers may be distributed irregularly through the environment. Additionally or alternatively, because the operational parameters may be based on the first and second acoustic properties, the operational parameters may cause audio to be generated that has been configured specifically for the speakers of the audio system. Additionally or alternatively, because the operational parameters may be based on the third acoustic properties, the operational parameters may cause audio to be generated that has been configured specifically for the environment.

Modifications, additions, or omissions may be made to method 800 without departing from the scope of the present disclosure. For example, the functions and/or operations described may be implemented in differing order than presented or one or more operations may be performed at substantially the same time. Additionally, one or more operations may be performed with respect to each of multiple virtual computing environments at the same time. Furthermore, the outlined functions and operations are only provided as examples, and some of the functions and operations may be optional, combined into fewer functions and operations, or expanded into additional functions and operations without detracting from the essence of the disclosed embodiments.

Figure 9:
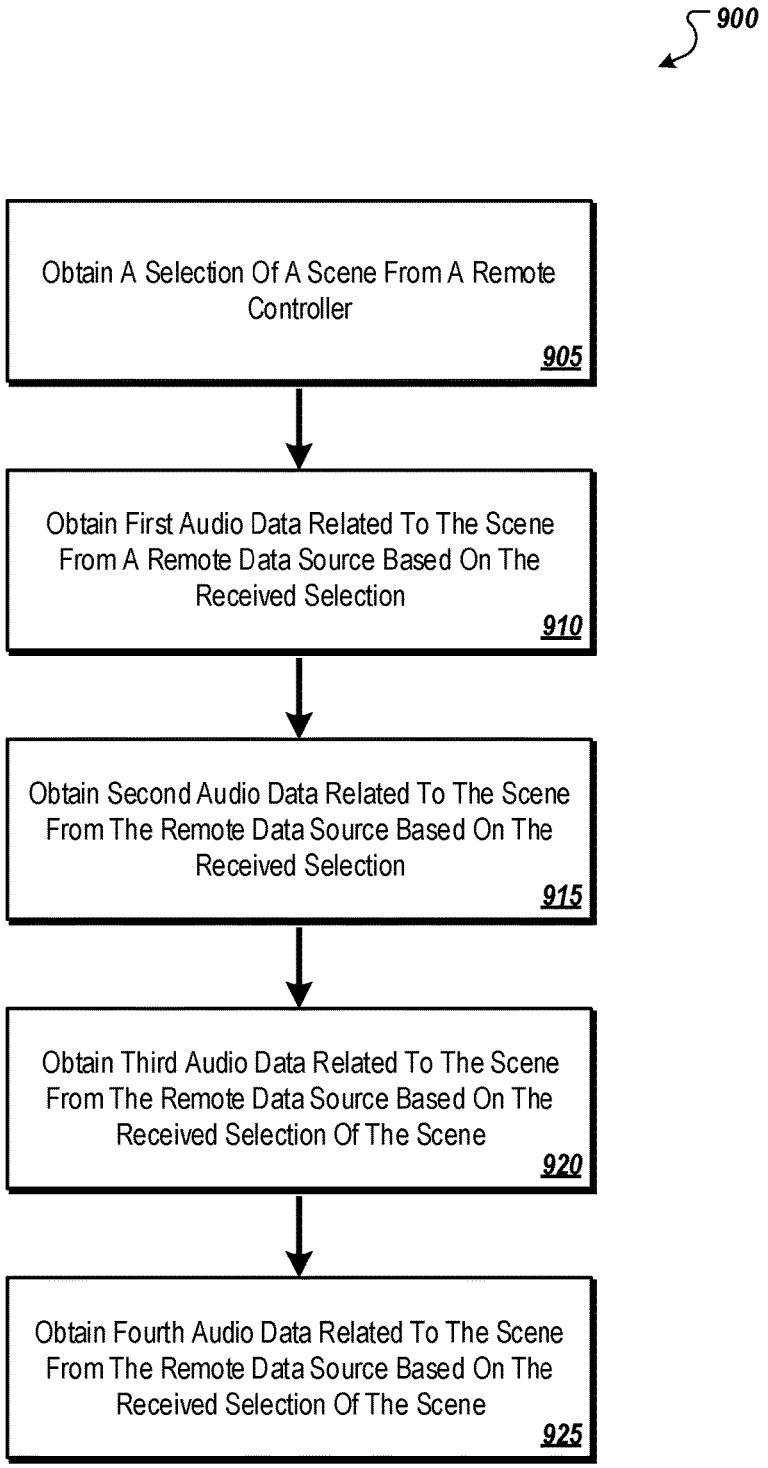
FIG. 9 illustrates an example flow diagram of an example method that may be used by an example audio system to prepare the example audio system to generate audio related to a scene.

FIG. 9 illustrates an example flow diagram of an example method 900 that may be used to generate dynamic audio arranged in accordance with at least one embodiment described in this disclosure. In some embodiments one or more operations associated with the method 900 may be performed by the audio signal generator 100 of FIG. 1. In some embodiments, the method 900 may be implemented at an audio system such as, for example, the audio system 300 of FIG. 3, and/or the audio system 400 of FIG. 4. Although illustrated with discrete blocks, the steps and operations associated with one or more of the blocks of the method 900 may be divided into additional blocks, combined into fewer blocks, or eliminated, depending on the desired implementation. In general, operations associated with the method 900 may cause the audio system to be prepared to generate audio related to the scene.

The method 900 may include the block 905. At the block 905 a selection of a scene may be obtained. The selection of the scene may be obtained by the audio system. The selection of the scene may be sent by a controller, such as, for example, the controller 330 of FIG. 3 or the controller 430 of FIG. 4.

The selection of the scene may be made from a list of scenes available. The audio data source may have a list of scenes available at that audio data source or at other audio data sources.

The scene may include one or more virtual environments, virtual objects, sound properties, location properties, behavior profiles, and/or audio data. The scene may be related to one or more audio data or categories of audio data.

The method 900 may include the block 910. At the block 910 first audio data related to the scene may be obtained. The first audio data may be obtained by the audio system. The first audio data may be sent by, or downloaded from an audio data source, such as, for example, the audio data source 320 of FIG. 3 or the audio data source 420 of FIG. 4. The first audio data may be audio data included in, or related to the scene.

The method 900 may include the block 915. At the block 915 second audio data related to the scene may be obtained. The operations associated with block 915 and the second audio data may be the same or similar as the operations associated with block 910 and the first audio data. The second audio data may be obtained from the same audio data source that the first audio data was obtained from, or the second audio data may be obtained from a different audio data source.

The method 900 may include the block 920. At the block 920 third audio data related to the scene may be obtained. The operations associated with block 920 and the third audio data may be the same or similar as the operations associated with block 910 and the first audio data. The third audio data may be obtained from the same audio data source that the first audio data was obtained from, or the third audio data may be obtained from a different audio data source.

The method 900 may include the block 925. At the block 925 fourth audio data related to the scene may be obtained. The operations associated with block 925 and the fourth audio data may be the same or similar as the operations associated with block 910 and the first audio data.

Modifications, additions, or omissions may be made to method 900 without departing from the scope of the present disclosure. For example, the functions and/or operations described may be implemented in differing order than presented or one or more operations may be performed at substantially the same time. Additionally, one or more operations may be performed with respect to each of multiple virtual computing environments at the same time. Furthermore, the outlined functions and operations are only provided as examples, and some of the functions and operations may be optional, combined into fewer functions and operations, or expanded into additional functions and operations without detracting from the essence of the disclosed embodiments.

Figure 10:
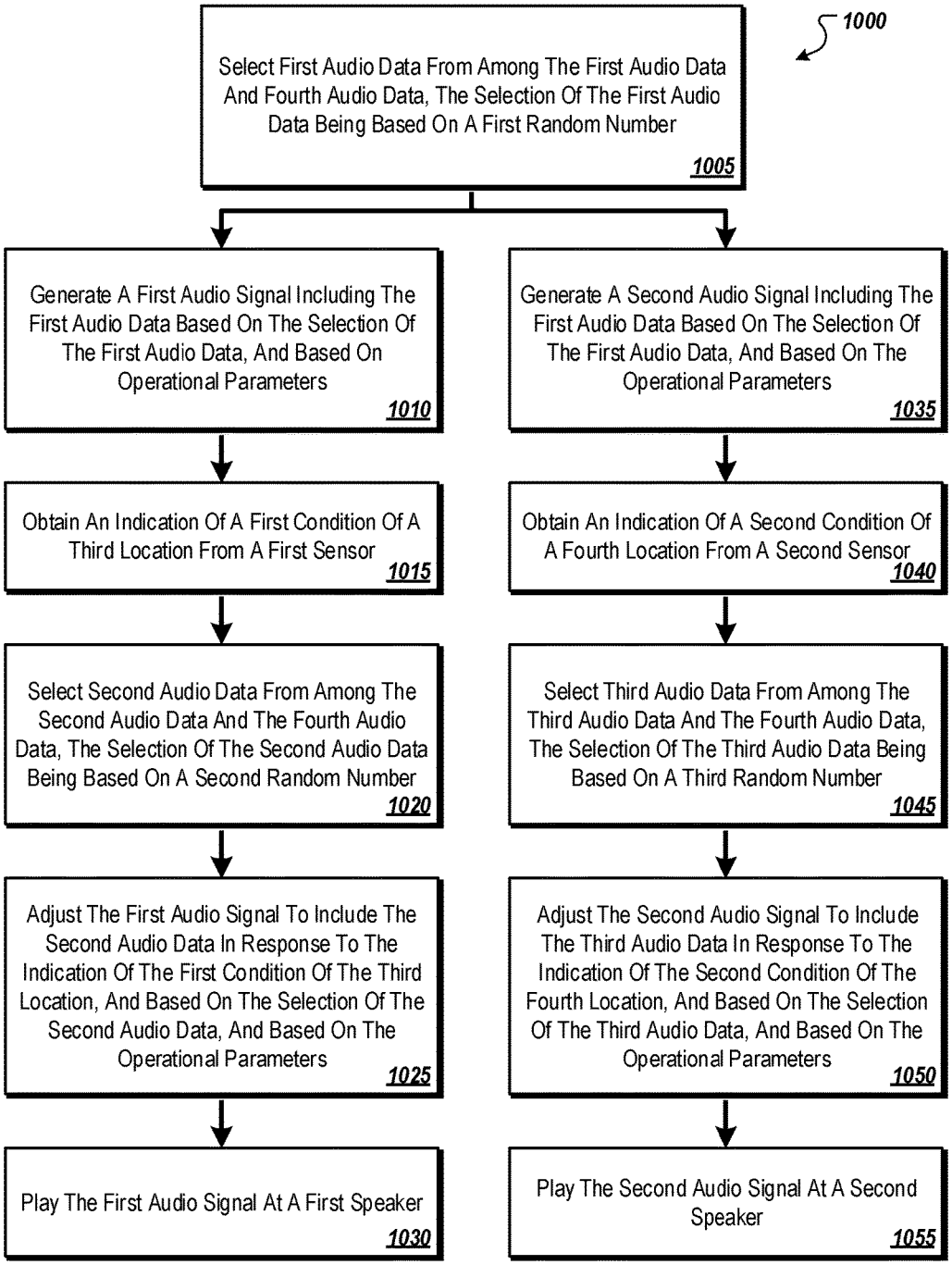
FIG. 10 illustrates an example flow diagram of an example method that may be used by an example audio system to generate dynamic audio in an environment.

FIG. 10 illustrates an example flow diagram of an example method 1000 that may be used to generate dynamic audio arranged in accordance with at least one embodiment described in this disclosure. In some embodiments one or more operations associated with the method 1000 may be performed by the audio signal generator 100 of FIG. 1. In some embodiments, the method 1000 may be implemented at an audio system such as, for example, the audio system 300 of FIG. 3, and/or the audio system 400 of FIG. 4. Although illustrated with discrete blocks, the steps and operations associated with one or more of the blocks of the method 1000 may be divided into additional blocks, combined into fewer blocks, or eliminated, depending on the desired implementation. In general, operations associated with the method 1000 may cause audio to be generated in the environment.

The method 1000 may include the block 1005. At the block 1005 first audio data may be selected. The first audio data may be selected from among the first audio data and fourth audio data. The selection of the first audio data may be based on a first random number. In some embodiments the first audio data and the fourth audio data may be related, or of the same category. For example, the first audio data and the fourth audio data may both be sounds of waves crashing. The first audio data and the fourth audio data may have been obtained previously for example, in a method the same or similar as method 900.

The method 1000 may include the block 1010. At the block 1010 a first audio signal may be generated. The first audio signal may be generated including the first audio data. The inclusion of the first audio data may be based on the selection of the first audio data. The generation of the first audio signal may be based on operational parameters. The first audio data may be adjusted prior to its inclusion in the first audio signal. For example, one or more of a volume level, a frequency content, dynamics, a playback speed, or a playback duration of the first audio data may be adjusted for the inclusion of the first audio data in the first audio signal. The operational parameters may have been generated previously in a method the same or similar as method 800. There may be unique operational parameters for the first speaker.

The method 1000 may include the block 1015. At the block 1015 an indication of a first condition of a third location may be obtained. The indication may be obtained at the audio system in some embodiments. The indication may be obtained from a first sensor. The indication may include a positive identification of the first condition. Additionally or alternatively the indication may include information that may be interpreted to determine the first condition.

The method 1000 may include the block 1020. At the block 1020 second audio data may be selected. The second audio data may be selected from among the second audio data and the fourth audio data. The selection of the second audio data may be based on a second random number. In some embodiments the second audio data and the fourth audio data may be related, or of the same category. For example, the second audio data and the fourth audio data may both be birdsongs of a swallow. The second audio data and the fourth audio data may have been obtained previously for example, in a method the same or similar as method 900.

The method 1000 may include the block 1025. At the block 1025 the first audio signal may be adjusted to include the second audio data. The adjustment of the first audio signal may be in response to the indication of the first condition of the third location. The adjustment of the first audio signal to include the second audio data may be based on the selection of the second audio data. The adjustment of the first audio signal may result in the first audio signal including both the first audio data and the second audio data. The adjustment of the first audio signal may be based on operational parameters. The operational parameters may have been generated previously in a method the same or similar as method 800.

Additionally or alternatively the first audio data and/or the second audio data in the first audio signal may be adjusted in response to the indication of the first condition of the third location. For example, the volume of the first audio data and the second audio data may be adjusted in the first audio signal. Additionally or alternatively, the first audio data may be excluded from the first audio signal in response to the first condition of the third location.

Additionally or alternatively the first audio data and/or the second audio data in the first audio signal may be adjusted in response to a fourth random number. For example, the second audio data may be included in the first audio signal at a random time, with a random volume level, or with a random alteration to the frequency content of the second audio data.

The method 1000 may include the block 1030. At the block 1030 the first audio signal may be played at a first speaker. The playing of the first audio signal at the first speaker may generate audio in the environment.

The method 1000 may include the block 1035. At the block 1035 a second audio signal may be generated. The second audio signal may be generated including the first audio data. The inclusion of the first audio data may be based on the selection of the first audio data. The generation of the second audio signal may be based on operational parameters. The first audio data may be adjusted prior to its inclusion in the second audio signal. For example, one or more of a volume level, a frequency content, dynamics, a playback speed, or a playback duration of the first audio data may be adjusted for the inclusion of the first audio data in the second audio signal. The operational parameters may have been generated previously in a method the same or similar as method 800. There may be unique operational parameters for the second speaker. And, because the second speaker may have operational parameters different from the first speaker, the first audio signal may differ from the second audio signal, even though both the first audio signal and the second audio signal include the first audio data.

The method 1000 may include the block 1040. At the block 1040 an indication of a second condition of a fourth location may be obtained. The indication may be obtained at the audio system. The indication may be obtained from a second sensor. The indication may include a positive identification of the second condition. Additionally or alternatively the indication may include information that may be interpreted to determine the second condition.

The method 1000 may include the block 1045. At the block 1045 third audio data may be selected. The third audio data may be selected from among the third audio data and the fourth audio data. The selection of the third audio data may be based on a third random number. In some embodiments the third audio data and the fourth audio data may be related, or of the same category. For example, the second audio data and the fourth audio data may both be sounds of a bird taking flight. The third audio data and the fourth audio data may have been obtained previously for example, in a method the same or similar as method 900.

The method 1000 may include the block 1050. At the block 1050 the second audio signal may be adjusted to include the third audio data. The adjustment of the second audio signal may be in response to the indication of the second condition of the fourth location. The adjustment of the second audio signal to include the third audio data may be based on the selection of the third audio data. The adjustment of the second audio signal may result in the second audio signal including both the first audio data and the third audio data. The adjustment of the second audio signal may be based on operational parameters. The operational parameters may have been generated previously in a method the same or similar as method 800.

Additionally or alternatively the first audio data in the second audio signal may be adjusted in response to the indication of the second condition of the fourth location. For example, the volume of the first audio data may be adjusted in the second audio signal. Additionally or alternatively, the first audio data may be excluded from the second audio signal in response to the first condition of the third location.

Additionally or alternatively the first audio data and/or the second audio data in the second audio signal may be adjusted in response to a fifth random number. For example, the second audio data may be included in the second audio signal at a random time, with a random volume level, or with a random alteration to the frequency content of the second audio data.

Additionally or alternatively the first audio signal may be adjusted in response to the indication of the second condition of the fourth location. For example, the volume of the first audio data may be adjusted in the first audio signal. For another example, the third audio data may be included in the first audio signal in response to the second condition of the fourth location.

The method 1000 may include the block 1055. At the block 1055 the second audio signal may be played at a second speaker. The playing of the second audio signal at the second speaker may generate audio in the environment.

Modifications, additions, or omissions may be made to method 1000 without departing from the scope of the present disclosure. For example, the functions and/or operations described may be implemented in differing order than presented or one or more operations may be performed at substantially the same time. For example, the block 1020 may occur before the block 1015. For another example, the block 1005 and the block 1035 may occur simultaneously. Furthermore, the block 1005, the block 1010, the block 1015, the block 1020, the block 1025, and the block 1030 may occur for example, at a first smart speaker such as, for example the smart speaker 304A of FIG. 3, while the block 1035, the block 1040, the block 1045, the block 1050, and the block 1055 are occurring for example, at a second smart speaker such as, for example, the smart speaker 304B of FIG. 3. Additionally or alternatively the block 1005, the block 1010, the block 1015, the block 1020, the block 1025, the block 1035, the block 1040, the block 1045, and the block 1050 may occur concurrently at a computing system, such as, for example, the computing system 410 of FIG. 4, while the block 1030 and the block 1055 occur at a speaker.

Additionally, one or more operations may be performed with respect to each of multiple virtual computing environments at the same time. Furthermore, the outlined functions and operations are only provided as examples, and some of the functions and operations may be optional, combined into fewer functions and operations, or expanded into additional functions and operations without detracting from the essence of the disclosed embodiments.

In some embodiments an audio system may include a communication interface that may be configured to obtain first audio data and second audio data from an audio data source. The audio system may also include memory that may be communicatively coupled to the communication interface, the memory may be configured to store the first audio data and the second audio data. The audio system may also include a sensor configured to detect a condition an environment and to produce a sensor output signal that may represent the condition of the environment. The audio system may also include one or more processors communicatively coupled to the memory and the sensor, the one or more processors may be configured to cause performance of operations. The operations may include generating an audio signal including the first audio data. The operations may also include adjusting the audio signal to include the second audio data based on the first sensor output signal. The audio system may also include a speaker configured to provide audio based on the audio signal.

In some embodiments which include generating an audio signal based on first audio data, and adjusting the audio signal based on second audio data, generating the audio signal may further include adjusting one or more settings of the first audio data based on the speaker and based on the environment.

In some embodiments which include generating an audio signal based on first audio data, and adjusting the audio signal based on second audio data, adjusting the audio signal may further include adjusting one or more of one or more first settings of the first audio data and one or more second settings of the second audio data for the speaker and the environment.

In some embodiments which include generating an audio signal based on first audio data, and adjusting the audio signal based on second audio data, generating the audio signal may further include adjusting one or more settings of the first audio data based on a random number.

In some embodiments which include generating an audio signal based on first audio data, and adjusting the audio signal based on second audio data, generating the audio signal may further include including third audio data in the audio signal based on selecting the third audio data from among the third audio data and fourth audio data. The selecting of the third audio data instead of the fourth audio data may be based on a random number.

In some embodiments which include generating an audio signal based on first audio data, and adjusting the audio signal based on second audio data, adjusting the audio signal may include selecting the second audio data for inclusion in the audio signal from among the second audio data, and third audio data, wherein the selecting of the second audio data may be based on a random number.

In some embodiments which include generating an audio signal based on first audio data, and adjusting the audio signal based on second audio data, the first audio data may include a stream of data that may have been recorded by a three-dimensional microphone in another environment.

In some embodiments which include generating an audio signal based on first audio data, and adjusting the audio signal based on second audio data, the first audio data may include a stream of data that has been recorded in another environment. And when generating the audio signal, the one or more processors may be configured to adjust one or more settings of the first audio data based on the speaker and based on the environment.

In some embodiments which include generating an audio signal based on first audio data, and adjusting the audio signal based on second audio data, the first audio data may include a stream of data that has been recorded in another environment for the environment.

In some embodiments which include generating a first audio signal based on first audio data, adjusting the first audio signal based on second audio data, generating a second audio signal based on the first audio data, and adjusting the second audio signal based on second audio data, generating the first audio signal, may include adjusting one or more first settings of the audio data for the first speaker. And generating the second audio signal may include adjusting one or more second settings of the audio data for the second speaker.

In some embodiments which include generating a first audio signal based on first audio data, adjusting the first audio signal based on second audio data, generating a second audio signal based on the first audio data, and adjusting the second audio signal based on second audio data, the audio data may include a multi-channel stream of data that has been recorded by one or more microphones in another environment.

In some embodiments which include generating a first audio signal based on first audio data, adjusting the first audio signal based on second audio data, generating a second audio signal based on the first audio data, and adjusting the second audio signal based on second audio data, the first audio data may include a first stream of data, and a second stream of data. And generating the first audio signal, may include including the first stream of data in the first audio signal. And generating the second audio signal may include including the second stream of data in the second audio signal.

In some embodiments which include generating a first audio signal based on first audio data, adjusting the first audio signal based on second audio data, generating a second audio signal based on the first audio data, and adjusting the second audio signal based on second audio data, the first audio data may include a first stream of data, and a second stream of data. And adjusting the first audio signal, may include adjusting one or more settings of the first stream of data in the first audio signal. And adjusting the second audio signal may include adjusting one or more settings of the second stream of data in the second audio signal.

In some embodiments the communication interface, the memory, the one or more processors, and the speaker may be connected, to form a smart speaker. In these or other embodiments the sensor may also be connected as part of the smart speaker.

In some embodiments the condition of the environment may include an ambient noise level. Additionally or alternatively the condition of the environment may include a light level. Additionally or alternatively the condition of the environment may include an occupancy status. Additionally or alternatively the condition of the environment may include a location of a person in the environment.

In some embodiments which include generating an audio signal based on audio data, and adjusting the audio signal, adjusting the audio signal may include adjusting one or more characteristics of the audio signal based on the sensor output signal indicating a change in the condition of the environment.

In some embodiments which include generating an audio signal based on audio data, and adjusting the audio signal, adjusting the audio signal may include characterizing the condition of the environment; and adjusting the audio signal based on the characterization.

In some embodiments including a first sensor positioned in a first location in the environment configured to detect a first condition of the environment and to produce a first sensor output signal representing the first condition of the first location, the audio system may further include a second sensor positioned in a second location in the environment. The second sensor may be configured to detect a second condition of the second location of the environment. The second sensor may be configured to produce a second sensor output signal that may represent the second detected condition of the second location of the environment. The one or more processors may be further configured to adjust the audio signal based on the second sensor output signal.

In some embodiments including a first speaker configured to provide audio based on a first audio signal and having a first set of one or more processors the audio system may further include a second speaker configured to provide audio based on a second audio signal. The second speaker may have a second set of one or more processors, the second set of one or more processors may be configured to cause performance of operations. The operations may include generating the second audio signal including the audio data; and adjusting the audio signal based on the sensor output signal.

In some embodiments an audio system may include a communication interface that may be configured to obtain audio data from an audio data source. The audio system may also include memory that may be communicatively coupled to the communication interface, the memory may be configured to store the audio data. The audio system may also include a sensor configured to detect a condition an environment and to produce a sensor output signal that may represent the condition of the environment. The audio system may also include one or more processors communicatively coupled to the memory and the sensor, the one or more processors may be configured to cause performance of operations. The operations may include generating an audio signal based on the audio data. The operations may also include adjusting the one or more settings of the audio signal based on the first sensor output signal. The audio system may also include a speaker configured to provide audio based on the audio signal.

In some embodiments an audio system may include a communication interface configured to obtain audio data from an audio data source. The audio system may also include memory communicatively coupled to the communication interface, the memory may be configured to store the audio data. The audio system may also include a sensor configured to detect a condition of an environment and to produce a sensor output signal that represents the detected condition of the environment. The audio system may also include a first set of one or more processors communicatively coupled to the memory and the sensor, the first set of one or more processors may be configured to cause performance of operations. The operations may include generating a first audio signal based on the audio data. The operations may also include adjusting the first audio signal based on the sensor output signal. The operations may include generating a second audio signal based on the audio data. The operations may also include adjusting the second audio signal based on the sensor output signal. The audio system may also include a first speaker configured to provide audio based on the first audio signal. The audio system may also include a second speaker configured to provide audio based on the second audio signal.

In some embodiments an audio system may include a communication interface configured to obtain audio data from an audio data source. The audio system may also include memory communicatively coupled to the communication interface, the memory may be configured to store the audio data. The audio system may also include a sensor configured to detect a condition of an environment and to produce a sensor output signal that represents the detected condition of the environment. The audio system may also include a first set of one or more processors communicatively coupled to the memory and the sensor, the first set of one or more processors may be configured to cause performance of first operations. The first operations may include generating a first audio signal based on the audio data. The first operations may also include adjusting the first audio signal based on the sensor output signal. The audio system may also include a second set of one or more processors which may be configured to cause performance of second operations. The second operations may include generating a second audio signal based on the audio data. The second operations may also include adjusting the second audio signal based on the sensor output signal. The audio system may also include a first speaker configured to provide audio based on the first audio signal. The audio system may also include a second speaker configured to provide audio based on the second audio signal. The audio system may also include a third speaker which may be configured to provide audio playback of a third audio signal, wherein the first operations may also include generating the third audio signal based on the audio data. The first operations may also include adjusting the third audio signal based on the sensor output signal. The audio system may also include a second sensor positioned in a second location in the environment, and wherein the second sensor may be configured to detect a second condition of the second location of the environment. The second sensor may be configured to produce a second sensor output signal that may represent the second detected condition of the second location of the environment. The first operations may also include adjusting the first audio signal based on the second sensor output data. The second operations may also include adjusting the second audio signal based on the second sensor output data.

In some embodiments an audio system may include a communication interface that may be configured to obtain audio data from an audio data source. The audio system may also include memory that may be communicatively coupled to the communication interface, the memory may be configured to store the audio data. The audio system may also include a first sensor configured to detect a first condition of a first location of an environment and to produce a first sensor output signal that may represent the first condition of the first location. The audio system may also include a second sensor configured to detect a second condition of a second location of the environment and to produce a second sensor output signal that may represent the second condition of the second location. The audio system may also include one or more processors communicatively coupled to the memory and the sensor, the one or more processors may be configured to cause performance of operations. The operations may include generating an audio signal based on the audio data. The operations may also include adjusting the audio signal based on the first sensor output signal. The operations may also include adjusting the audio signal based on the second sensor output signal. The audio system may also include a first speaker configured to provide audio based on the audio signal.

In some embodiments an audio system may include a communication interface that may be configured to obtain audio data from an audio data source. The audio system may also include memory that may be communicatively coupled to the communication interface, the memory may be configured to store the audio data. The audio system may also include a first sensor configured to detect a first condition of a first location of an environment and to produce a first sensor output signal that may represent the first condition of the first location. The audio system may also include a second sensor configured to detect a second condition of a second location of the environment and to produce a second sensor output signal that may represent the second condition of the second location. The audio system may also include a first set of one or more processors communicatively coupled to the memory and the sensor, the first set one or more processors may be configured to cause performance of first operations. The first operations may include generating a first audio signal based on the audio data. The first operations may also include adjusting the first audio signal based on the first sensor output signal. The audio system may also include a second set of one or more processors communicatively coupled to the memory and the sensor, the second set of one or more processors may be configured to cause performance of second operations. The second operations may include generating a second audio signal based on the audio data. The second operations may also include adjusting the second audio signal based on the second sensor output signal. The audio system may also include a first speaker configured to provide audio based on the first audio signal. The audio system may also include a second speaker configured to provide audio based on the second audio signal.

Some embodiments may include a method. The method may include configuring an audio system positioned in an environment for operation in the environment. The configuring of the audio system may include obtaining a first location of a first speaker of the audio system in the environment. The configuring of the audio system may also include obtaining a second location of a second speaker of the audio system in the environment. The configuring of the audio system may also include obtaining a third location of a first sensor of the audio system in the environment. The configuring of the audio system may also include obtaining a fourth location of a second sensor of the audio system in the environment. The configuring of the audio system may also include obtaining first acoustic properties of the first speaker. The configuring of the audio system may also include obtaining second acoustic properties of the second speaker. The configuring of the audio system may also include obtaining third acoustic properties of the environment. The configuring of the audio system may also include generating operational parameters based on the first location, the second location, the first acoustic properties, the second acoustic properties, and the third acoustic properties.

The method may also include preparing the audio system to generate sound related to a scene. The preparing of the audio system may include obtaining a selection of the scene. The preparing of the audio system may also include obtaining first audio data related to the scene based on the obtained selection. The preparing of the audio system may also include obtaining second audio data related to the scene based on the obtained selection. The preparing of the audio system may also include obtaining third audio data related to the scene based on the obtained selection of the scene. The preparing of the audio system may also include obtaining fourth audio data related to the scene based on the obtained selection of the scene.

The method may also include obtaining a signal to initiate operation of the audio system. The method may also include generating audio in the environment, in response to receiving the signal to initiate operation of the audio system. The generating of audio may include selecting the first audio data from among the first audio data and the fourth audio data, the selecting of the first audio data based on a first random number. The generating of audio may also include generating a first audio signal including the first audio data based on the selection of the first audio data, and based on the operational parameters. The generating of audio may also include receiving an indication of a first condition of the third location from the first sensor. The generating of audio may also include selecting the second audio data from among the second audio data and the fourth audio data, the selecting of the second audio data based on a second random number. The generating of audio may also include adjusting the first audio signal to include the second audio data in response to the indication of the first condition of the third location, and based on the selecting of the second audio data, and based on the operational parameters. The generating of audio may also include playing the first audio signal at the first speaker. The generating of audio may also include generating a second audio signal including the first audio data based on the selection of the first audio data, and based on the operational parameters. The generating of audio may also include receiving an indication of a second condition of the fourth location from the second sensor. The generating of audio may also include selecting the third audio data from among the third audio data and the fourth audio data, the selecting of the third audio data based on a third random number. The generating of audio may also include adjusting the second audio signal to include the third audio data in response to the indication of the second condition of the fourth location, and based on the selection of the third audio data, and based on the operational parameters. The generating of audio may also include playing the second audio signal at the second speaker.

Terms used herein and especially in the appended claims (e.g., bodies of the appended claims) are generally intended as "open" terms (e.g., the term "including" may be interpreted as "including, but not limited to," the term "having" may be interpreted as "having at least," the term "includes" may be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases may not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" may be interpreted to mean "at least one" or "one or more"); the same holds true for the use of definite articles used to introduce claim recitations.

In addition, even if a specific number of an introduced claim recitation is explicitly recited, those skilled in the art will recognize that such recitation may be interpreted to mean at least the recited number (e.g., the bare recitation of "two recitations," without other modifiers, means at least two recitations, or two or more recitations). Further, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, may be understood to contemplate the possibilities of including one of the terms, either of the terms, or both terms. For example, the phrase "A or B" may be understood to include the possibilities of "A" or "B" or "A and B."

Embodiments described herein may be implemented using computer-readable media for carrying or having computer-executable instructions or data structures stored thereon. Such computer-readable media may be any available media that may be accessed by a general purpose or special purpose computer. By way of example, and not limitation, such computer-readable media may include non-transitory computer-readable storage media including Random Access Memory (RAM), Read-Only Memory (ROM), Electrically Erasable Programmable Read-Only Memory (EEPROM), Compact Disc Read-Only Memory (CD-ROM) or other optical disk storage, magnetic disk storage or other magnetic storage devices, flash memory devices (e.g., solid state memory devices), or any other storage medium which may be used to carry or store desired program code in the form of computer-executable instructions or data structures and which may be accessed by a general purpose or special purpose computer. Combinations of the above may also be included within the scope of computer-readable media.

Computer-executable instructions may include, for example, instructions and data which cause a general purpose computer, special purpose computer, or special purpose processing device (e.g., one or more processors) to perform a certain function or group of functions. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

As used herein, the terms "module" or "component" may refer to specific hardware implementations configured to perform the operations of the module or component and/or software objects or software routines that may be stored on and/or executed by general purpose hardware (e.g., computer-readable media, processing devices, etc.) of the computing system. In some embodiments, the different components, modules, engines, and services described herein may be implemented as objects or processes that execute on the computing system (e.g., as separate threads). While some of the system and methods described herein are generally described as being implemented in software (stored on and/or executed by general purpose hardware), specific hardware implementations or a combination of software and specific hardware implementations are also possible and contemplated. In this description, a "computing entity" may be any computing system as previously defined herein, or any module or combination of modulates running on a computing system.

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present disclosure have been described in detail, it may be understood that the various changes, substitutions, and alterations may be made hereto without departing from the spirit and scope of the present disclosure.

What is claimed is:

1. An audio system, comprising:

a communication interface configured to obtain first audio data and second audio data from an audio data source;

memory communicatively coupled to the communication interface, the memory configured to store first audio data and second audio data;

a first sensor configured to detect a first condition of an environment and to produce a first sensor output signal that represents the detected first condition of the environment;

a first set of one or more processors communicatively coupled to the memory and the first sensor, the first set of one or more processors configured to cause performance of operations, the operations including:

generate a first audio signal including the first audio data; and adjust the first audio signal to include the second audio data based on the first sensor output signal; and a first speaker communicatively coupled to the one or more processors, the first speaker configured to provide an audio experience based on the first audio signal.

2. The audio system of claim 1, the audio system further comprising:

a second set of one or more processors communicatively coupled the first sensor, the second set of one or more processors configured to generate a second audio signal; and a second speaker communicatively coupled to the second set of one or more processors, the second speaker configured to contribute to the audio experience based on at least one of the first audio signal and the second audio signal.

3. The audio system of claim 2, wherein the audio system further comprises a second sensor configured to detect a second condition of the environment and to produce a second sensor output signal that represents the detected second condition of the environment, wherein the second set of processors are further configured to adjust the second audio signal to include third audio data based on the second sensor output signal.

4. The audio system of claim 1, the operations further including generating a third audio signal including the first audio data; and the audio system further comprising a third speaker, the third speaker configured to contribute to the audio experience based on at least one of the first audio signal, the second audio signal, and the third audio signal.

5. The audio system of claim 1, wherein the adjustment of the first audio signal is based on third-party data from a data provider according to one or more rules that govern the adjustment of the first audio signal based on a type of the third-party data, and the third-party data.

6. The audio system of claim 1, wherein the audio system further comprises a third sensor configured to detect a third condition of the environment and to produce a third sensor output signal that represents the detected third condition of the environment, wherein the operations further include adjust the first audio signal to include fourth audio data based on the third sensor output signal.

7. The audio system of claim 1, wherein the first speaker includes a first processor of the one or more processors, the first processor being configured to generate the first audio signal based on a first location of the first speaker in the environment.

8. The audio system of claim 7, wherein the audio system further comprises a fourth speaker configured to contribute to the audio experience based on a fourth audio signal, the fourth speaker including a second processor of the one or more processors, the second processor being configured to generate the fourth audio signal such that the audio experience includes first sound waves generated by the first speaker based on the first audio data and second sound waves generated by the fourth speaker based on the first audio data wherein the first sound waves and the second sound waves arrive at a predetermined location in the environment at substantially the same time.

9. A method, comprising:

obtaining a first location of a first speaker in an environment;

obtaining first audio data;

obtaining second audio data;

generating a first audio signal including the first audio data based on the location of the first speaker in the environment;

receiving a first indication of a first condition of the environment from a first sensor; and adjusting the first audio signal to include the second audio data in response to the first indication of the first condition of the environment, and based on the first location of the first speaker in the environment.

10. The method of claim 9, the method further comprising obtaining scene data, wherein the scene data comprises the first audio data, the second audio data, and third audio data, wherein generating the first audio signal including the first audio data comprises extracting the first audio data from the scene data.

11. The method of claim 10, wherein adjusting the first audio signal to include the second audio data further comprises extracting the second audio data from the scene data.

12. The method of claim 9, the method further comprising:

characterizing the first condition of the environment based on the received first indication of the condition; and comparing the characterization of the first condition of the environment with a set of rules of a scene, wherein the first audio signal is adjusted based on the comparing of the characterization of the first condition of the environment with the set of rules of the scene.

13. The method of claim 9, the method further comprising:

generating a ping signal at the first speaker;

receiving a reflection of the ping signal at the first sensor; and obtaining acoustic properties of the environment based on the ping signal and the received reflection of the ping signal.

14. The method of claim 9, further comprising:

obtaining a second location of a second speaker in the environment; and generating a second audio signal based on the second location of the second speaker.

15. The method of claim 14, the method further comprising:

obtaining a first acoustic property of the first speaker;

obtaining a second acoustic property of the second speaker;

obtaining a third acoustic property of the environment, wherein the generating of the first audio signal is based on the first acoustic property and the third acoustic property; and wherein the generating of the second audio signal is based on the second acoustic property and the third acoustic property.

16. The method of claim 14, wherein the first audio data comprises a stream of audio data, and wherein generating the first audio signal comprises including the stream of audio data at a first time, and wherein generating the second audio signal comprises including the stream of audio data at a second time, the second time being later than the first time by a time interval, the time interval being based on the location of the speaker and the second location of the second speaker.

17. The method of claim 14, further comprising:

obtaining third audio data;

obtaining a second indication of a second condition of the environment from a second sensor; and adjusting the second audio signal to include the third audio data in response to the second indication of the second condition of the environment, and based on the second location of the second speaker in the environment.

18. One or more non-transitory computer-readable storage media including computer-executable instructions that, when executed by one or more processors, cause a system to perform operations comprising:

obtain a first location of a first speaker in an environment;

obtain first audio data;

obtain second audio data;

generate a first audio signal including the first audio data based on the first location of the first speaker in the environment;

receive an indication of a condition of the environment from a sensor; and adjust the first audio signal to include the second audio data in response to the indication of the condition of the environment, and based on the first location of the first speaker in the environment.

19. The one or more non-transitory computer-readable storage media of claim 18 wherein the operations further comprise:

obtain a second location of a second speaker in the environment; and generate a second audio signal based on the second location of the second speaker.

20. The one or more non-transitory computer-readable storage media of claim 19 wherein the operations further comprise:

obtain a first acoustic property of the first speaker;

obtain a second acoustic property of the second speaker; and obtain a third acoustic property of the environment, wherein generating the first audio signal is based on the first acoustic property and the third acoustic property; and wherein generating the second audio signal is based on the second acoustic property and the third acoustic property.

* * * * *